US010039340B2

(12) United States Patent
Berberian et al.

(10) Patent No.: US 10,039,340 B2
(45) Date of Patent: Aug. 7, 2018

(54) SHOE WITH A HIGH HEEL TO LOW HEEL CONVERSION

(71) Applicant: High-Low Heel, LLC, Vancouver, WA (US)

(72) Inventors: Maria Mercedes Berberian, Vancouver, WA (US); Allen Nejah, San Jose, CA (US)

(73) Assignee: High-Low Heel, LLC, Vancouver, WA (US)

( * ) Notice: Subject to any disclaimer, the term of this patent is extended or adjusted under 35 U.S.C. 154(b) by 0 days.

(21) Appl. No.: 15/879,391

(22) Filed: Jan. 24, 2018

(65) Prior Publication Data

US 2018/0146740 A1 May 31, 2018

Related U.S. Application Data

(63) Continuation-in-part of application No. 14/876,576, filed on Oct. 6, 2015, now Pat. No. 9,877,537.

(51) Int. Cl.

| | |
|---|---|
| ***A43B 3/24*** | (2006.01) |
| ***A43B 13/37*** | (2006.01) |
| ***A43B 21/37*** | (2006.01) |
| ***A43B 21/42*** | (2006.01) |
| ***A43B 3/10*** | (2006.01) |

(52) U.S. Cl.

CPC ..... *A43B 3/246* (2013.01); *A43B 3/108* (2013.01); *A43B 13/37* (2013.01); *A43B 21/37* (2013.01); *A43B 21/42* (2013.01)

(58) Field of Classification Search

CPC ..... A43B 3/24; A43B 3/244; A43B 3/246; A43B 3/248; A43B 3/26; A43B 7/28; A43B 13/10; A43B 13/12; A43B 13/28; A43B 13/30; A43B 13/32; A43B 13/34; A43B 13/36; A43B 13/41; A43B 21/36; A43B 21/37; A43B 21/38; A43B 21/39; A43B 21/40; A43B 21/42; A43B 21/433; A43B 21/437

USPC ..... 36/42, 100, 107, 108

See application file for complete search history.

(56) References Cited

U.S. PATENT DOCUMENTS

| | | | | |
|---|---|---|---|---|
| 2,112,052 A | | 3/1938 | Smith | |
| 2,258,265 A | * | 10/1941 | Schwartz | A43B 21/433 36/100 |
| 2,943,404 A | * | 7/1960 | Sultan | A43B 21/36 36/42 |

(Continued)

FOREIGN PATENT DOCUMENTS

| | | | | |
|---|---|---|---|---|
| EP | 2078467 A1 | * | 7/2009 | A43B 7/144 |
| FR | 2678810 A1 | * | 1/1993 | A43B 7/142 |

(Continued)

OTHER PUBLICATIONS

International Search Report and Written Opinion for PCT/US2018/015319, dated Mar. 29, 2018.

*Primary Examiner* — Joshua E Rodden

(74) *Attorney, Agent, or Firm* — Kolisch Hartwell, P.C.

(57) ABSTRACT

A convertible shoe may include a sole portion and a plurality of interchangeable heel portions, each selectively attachable to the sole portion. The heel portions may each include a mounting surface configured to interface with a heel receiver of the sole, such that mounting the heel causes a support shank of the shoe to be secured in a longitudinal position relative to the sole.

20 Claims, 18 Drawing Sheets

(56) References Cited

U.S. PATENT DOCUMENTS

| | | | | | |
|---|---|---|---|---|---|
| 3,754,340 | A * | 8/1973 | Pais | A43B 21/37 | 36/42 |
| 4,670,996 | A | 6/1987 | Dill | | |
| 4,805,320 | A * | 2/1989 | Goldenberg | A43B 1/0054 | 36/36 R |
| 4,835,884 | A * | 6/1989 | Bianchini | A43B 13/28 | 36/108 |
| 5,133,138 | A | 7/1992 | Durcho | | |
| 5,309,651 | A | 5/1994 | Handel | | |
| 5,347,730 | A | 9/1994 | Rodriguez Colon | | |
| 5,519,950 | A * | 5/1996 | Wang | A43B 21/39 | 36/36 R |
| 6,631,570 | B1 | 10/2003 | Walker | | |
| 9,220,317 | B2 | 12/2015 | Green | | |
| 9,289,025 | B2 * | 3/2016 | Damodar | A43B 21/36 | |
| 9,326,565 | B1 | 5/2016 | Davis | | |
| 9,775,400 | B2 * | 10/2017 | Chang | A43B 13/122 | |
| 2006/0075662 | A1 * | 4/2006 | Schupbach | A43B 3/24 | 36/100 |
| 2006/0117601 | A1 * | 6/2006 | Chang | A43B 1/0072 | 36/24.5 |
| 2008/0244931 | A1 | 10/2008 | Gallegos | | |
| 2010/0139123 | A1 | 6/2010 | Alan et al. | | |
| 2014/0137436 | A1 * | 5/2014 | Saccullo | A43B 3/246 | 36/100 |
| 2014/0298685 | A1 * | 10/2014 | Alan | A43B 3/246 | 36/100 |
| 2016/0073725 | A1 | 3/2016 | Guenoun | | |
| 2016/0198795 | A1 | 7/2016 | Lopez-Velazquez et al. | | |
| 2017/0042276 | A1 * | 2/2017 | Alan | A43B 21/433 | |
| 2017/0095029 | A1 | 4/2017 | Berberian | | |
| 2017/0156441 | A1 * | 6/2017 | Ho | A43B 21/46 | |

FOREIGN PATENT DOCUMENTS

| | | | | |
|---|---|---|---|---|
| FR | 3005243 | A1 | 11/2014 | |
| GB | 408115 | | 4/1934 | |
| GB | 435824 | A * | 9/1935 | A43B 21/39 |
| GB | 1357033 | | 6/1974 | |
| GB | 2538967 | A | 12/2016 | |

* cited by examiner

FIG. 1
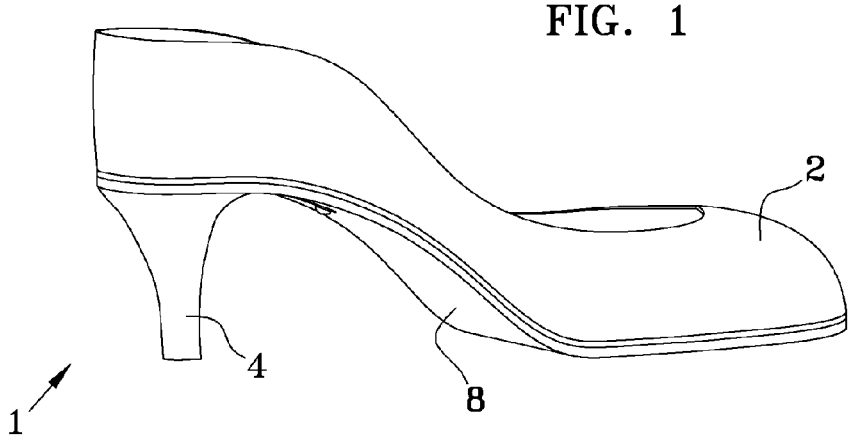
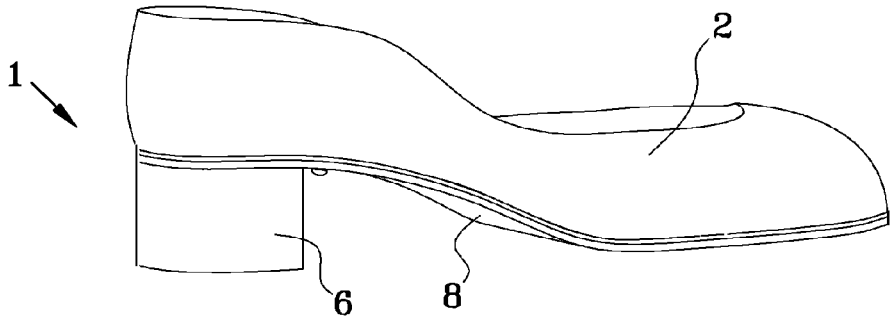
FIG. 2

SHOE WITH A HIGH HEEL TO LOW HEEL CONVERSION

CROSS-REFERENCES

This application is a continuation in part of U.S. patent application Ser. No. 14/876,576, now U.S. Pat. No. 9,877,537, filed Oct. 6, 2015, the entirety of which is hereby incorporated by reference for all purposes.

FIELD

This disclosure relates to footwear. More specifically, the disclosed embodiments relate to systems and methods for converting shoes and other footwear between high-heel and low-heel configurations.

INTRODUCTION

Style and comfort do not always go hand in hand. This is especially true when it comes to women's footwear. High heels, though a mainstay in most women's closets, fall short of being reasonably designed footwear. The height difference between the front and rear of these shoes causes wobbling and slipping even on unadorned, planar surfaces. Despite this, women continue to wear these fashion statements even though the original purpose of high heels, that of helping a rider secure their stance in the stirrups so they could shoot arrows more effectively from horseback, no longer exists. Through the years, high heels evolved into stilettos and pumps and have succumb to iconic branding such that many see such shoes as status symbols for success and perhaps femininity.

Unfortunately, continued use of elevated footwear leads to a plethora of physical problems manifesting itself in such things as planter fasciitis and neuroma while affecting other areas of the body such as the calves, knees and lower back. The American Podiatric Medical Association reports that women have four times as many foot issues as do men. High heels are dangerous to walk in and are subject to immediate frictional engagement with sidewalk grates and the like. The most common complaint about high heels is that they are slow and uncomfortable to walk in. For this reason, many working women carry a second pair of shoes, ones with a low heel or a shoe of a walking/running variety, to get them to and from the workplace. Since shoes accumulate dirt in use, this strategy not only requires one to carry a second set of shoes, it also requires a bag in which to transport them. For most women who carry a purse, this means both arms are full. The situation is worsened if there is a personal computing device such as a laptop computer or tablet that also must be transported daily to work.

Accordingly, a single pair of shoes that could be converted between a fashionable high and a comfortable low heel would fulfill a long felt need in the footwear industry. This new invention utilizes and combines known and new technologies in a unique and novel configuration to develop a convertible shoe that overcomes the aforementioned problems and provides a solution to a common workplace dilemma.

SUMMARY

The present disclosure provides systems, apparatuses, and methods relating to convertible footwear.

In some embodiments, an article of footwear may include a sole including a heel receiver; a support shank housed within the sole, wherein the support shank is at least partially movable relative to the sole; a block affixed to a rear portion of the support shank and passing generally downward through an aperture in the sole proximate the heel receiver, a dimension of the aperture in a heel-to-toe direction being larger than the block; and a first heel portion having a first wedge protruding generally upward from the first heel portion; wherein the article of footwear is in a first configuration, in which the first heel portion is removably secured to the heel receiver of the sole and the first wedge abuttingly holds the block of the support shank in a first longitudinal position against a first side of the aperture.

In some embodiments, an article of footwear may include a sole including a heel receiver; a support shank housed within the sole, wherein the support shank and the sole are at least partially movable relative to each other; a block affixed to a rear portion of the support shank and passing generally downward through an aperture in the sole proximate the heel receiver, a longitudinal dimension of the aperture being larger than the block; a first heel portion having a first wedge protruding generally upward from the first heel portion; and a second heel portion having a second wedge protruding generally upward from the second heel portion; wherein the article of footwear is transitionable between a first configuration, in which the first heel portion is removably secured to the heel receiver of the sole and the first wedge abuttingly holds the block of the support shank in a rearward position relative to the aperture, and a second configuration, in which the second heel portion is removably secured to the heel receiver of the sole and the second wedge abuttingly holds the block of the support shank in a forward position relative to the aperture.

Features, functions, and advantages may be achieved independently in various embodiments of the present disclosure, or may be combined in yet other embodiments, further details of which can be seen with reference to the following description and drawings.

BRIEF DESCRIPTION OF THE DRAWINGS

FIG. 1 is a side perspective view of an illustrative convertible shoe in a high heeled mode.

FIG. 2 is a side perspective view of an illustrative convertible shoe in a low heeled mode.

DETAILED DESCRIPTION

Figure 3:
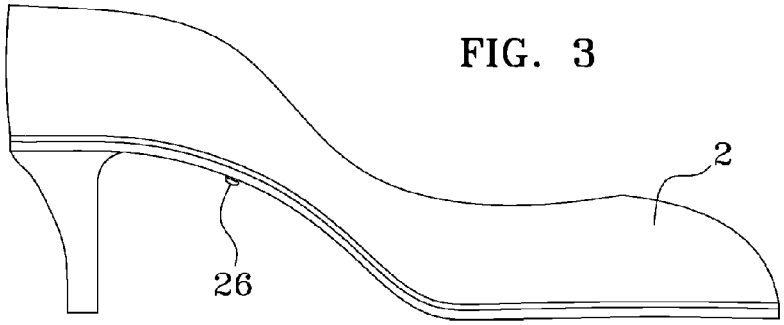
FIG. 3 is a side view of the convertible shoe in the high heeled mode.
Figure 4:
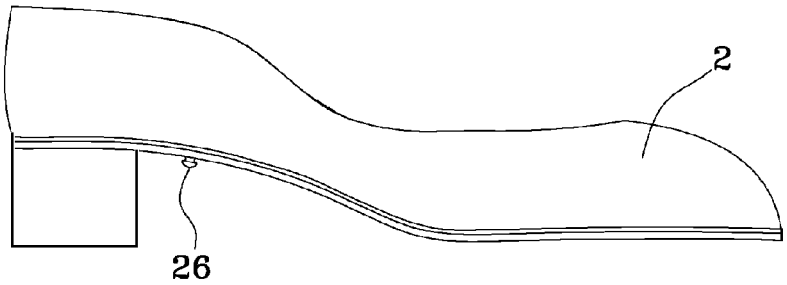
FIG. 4 is a side view of the convertible shoe in the low heeled mode.

Various aspects and examples of a shoe that is convertible between high-heel and low-heel modes and that has a support shank that is repositionable with respect to the shoe's sole, as well as related methods, are described below and illustrated in the associated drawings. Unless otherwise specified, a convertible shoe in accordance with the present teachings, and/or its various components may, but are not required to, contain at least one of the structures, components, functionality, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Illustrative Combinations and Additional Examples; (5) Advantages, Features, and Benefits; and (6) Conclusion. The Examples, Components, and Alternatives section is further divided into subsections A through D, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

Directional terms, such as "inboard," "outboard," "front," and "rear" (and the like) are intended to be understood in the context of the article of footwear on or in which components described herein may be mounted or otherwise attached. For example, "outboard" may indicate a relative position that is laterally farther from the centerline of a shoe, or a direction that is away from the shoe's longitudinal centerline. Conversely, "inboard" may indicate a direction toward the centerline, or a relative position that is closer to the centerline. Similarly, "forward" or "front" means toward the toe portion of the footwear, and "rear" or "back" means toward the heel portion of the footwear. Similarly, the term "longitudinal" generally refers to the heel-to-toe (length) direction of the footwear, while the term "lateral" generally refers to the side-to-side (width) direction of the footwear. In the absence of a host article of footwear, the same directional terms may be used as if the article were present. For example, even when viewed in isolation, a component may have a "forward" side, based on the fact that the component would be installed with the side in question facing in the direction of the toe portion of a shoe.

"Coupled" means connected, either permanently or releasably, whether directly or indirectly through intervening components.

The following terms relate to portions of a shoe or other article of footwear:

a. Breast: The forward facing part of the heel, under the arch of the sole.

b. Feather: The part of the shoe where the upper's edge meets the sole.

c. Heel: The part of the sole that raises the rear of the shoe in relation to the front.

d. Heel Cap: The part of the heel that contacts the ground. Also called the top piece.

e. Insole: A layer of material that sits inside the shoe that creates a layer between the outsole (or any intervening soles e.g. midsole) and the wearer's foot.

f. Outsole: The exposed part of the sole that is contact with the ground.

g. Seat: Where the heel of the foot sits in the shoe.

h. Shank: A piece of rigid material inserted somewhere between the outer face of the sole and the inner face of the insole, to as to cause the sole assembly to lie against the arch of the foot.

i. Sole Assembly: The part of the shoe that sits below the wearer's foot. The upper, sole, and heel make up the whole of the shoe.

j. Upper: The part of the shoe that covers the foot.

k. Welt: A strip of material that joins the upper to the sole. It may also be the midsole or eliminated in certain shoe designs.

Overview

When one shifts from walking on low heels to high heels the foot bends at the metatarsophalangeal joints located between the base of the proximal phalanx bones and the head of the metatarsal bones. The plantar fascia is then stretched beneath the tarsal bones. Thus, less of the weight of the person is carried by the calcaneus bone and more of the weight is carried by the metatarsal bones. Like walking on tip toes, this leaves this plantar fascia under tension. Over periods of time, this tension fatigues the foot. For this reason, high heeled shoes generally have a support shank made of a rigid material that runs down the longitudinal centerline of the shoe to transfer some of the load off of the heads of the metatarsal bones and back onto the remainder of the foot's bone structure. The support shank also generally has a slight arc along its length that serves to flex the plantar fascia slightly and reduce the point stress at its center. In normal walking, whether in high heels or low heels, the foot must flex and bend at the metatarsophalangeal joint. For this reason (to allow the flexing of the shoe with the foot) the support shank's proximal end begins somewhere behind the base of the proximal phalanx bones and its distal end terminates somewhere under the calcaneus bone. For obvious reasons this support shank must both be thin (to keep the thickness of the outsole/midsole/insole assembly to a minimum) and lightweight (to keep leg fatigue to a minimum). In a high heeled shoe the proximal end of the support shank begins just behind the base of the proximal phalanx bones, while in a low heeled shoe, the proximal end of the support shank is located further away from the base of the proximal phalanx bones and the distal end is located closer to the back of the calcaneus bone. So when walking in low heels the support shank shifts some of the load from the front of the foot and when walking in high heels the support shank shifts some of the load from the back of the foot. It also helps the shoe keep its overall shape, so that the heel cap meets the ground evenly across its face.

The longitudinal arc that the support shank traces varies with the shoe design and the height of the heel. Without the support shank the shoe may quickly break down and walking may become tedious and uncomfortable. Support of the foot may be moved more forward (toward the metatarsophalangeal joints) as the height of the heel increases to properly support both the foot and the shoe's body. For this reason the structural design of high heeled shoes and low heeled shoes can require different internal placements of the support shank.

In general, convertible footwear as disclosed herein may include a heel attachment mechanism that allows heel portions to be easily interchanged by the user, thereby converting the footwear between high-heel and low-heel configurations or modes. As discussed above, a support shank (also referred to as a support and/or a stiffener) is present in shoes and other footwear of the present disclosure, and this support shank is at least partially movable with respect to one or more remaining portions of the shoe. Furthermore, the movable support shank may be locked into selected positions (e.g., a forward position and a rearward position) by a locking mechanism that passes through the sole of the shoe and ensures the selected position is maintained during use. In some examples, the locking mechanism is externally accessible. In some examples, at least part of the locking mechanism is integrated into the interchangeable heel portions.

Examples, Components, and Alternatives

The following sections describe selected aspects of exemplary convertible shoes, as well as related systems and/or methods. The examples in these sections are intended for illustration and should not be interpreted as limiting the entire scope of the present disclosure. Each section may include one or more distinct embodiments or examples, and/or contextual or related information, function, and/or structure.

A. First Illustrative Convertible Shoe

As shown in FIGS. 1-11, this section describes an illustrative convertible shoe 1. Shoe 1 is an example of the convertible shoe described in the Overview above.

Figure 5:
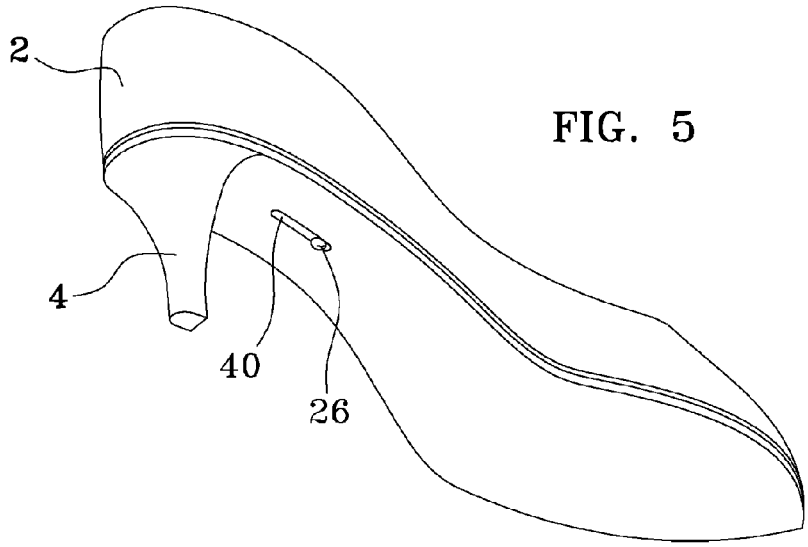
FIG. 5 is a bottom perspective view of the convertible shoe in the high heeled mode.
Figure 6:
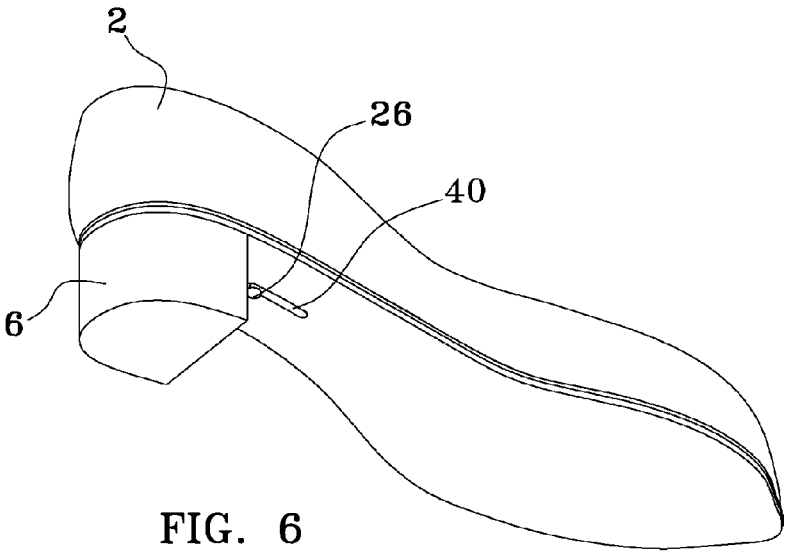
FIG. 6 is a bottom perspective view of the convertible shoe in the low heeled mode.
Figure 7:
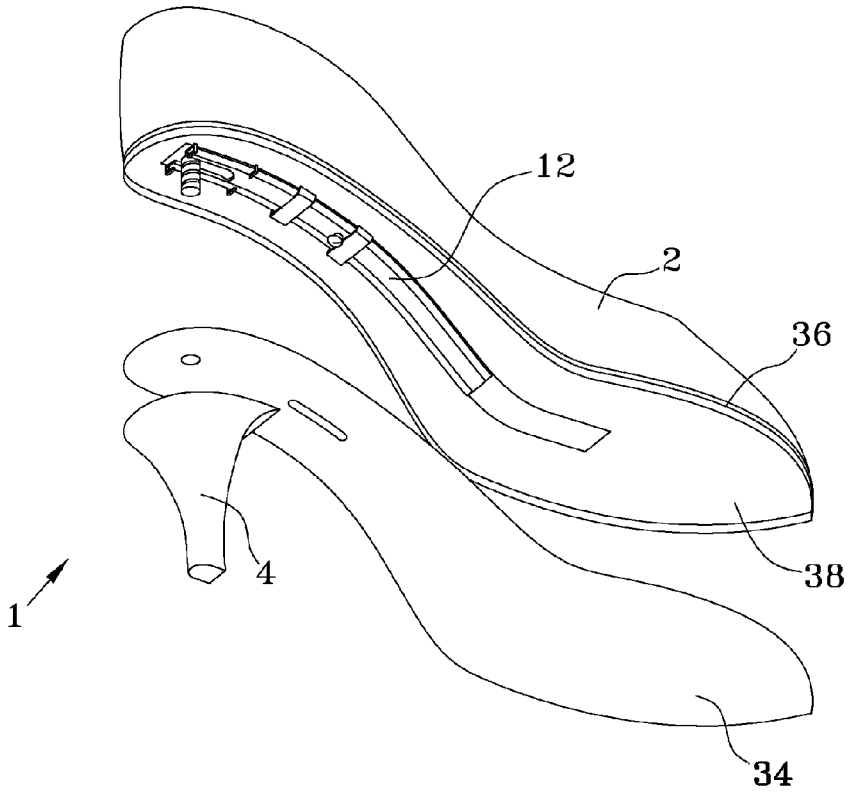
FIG. 7 is a bottom perspective exploded view of the convertible shoe in the high heeled mode.

Looking at FIGS. 1, 3, and 5, the general outward appearance of convertible shoe 1 in a high-heeled mode can best be seen. Looking at FIGS. 2, 4, and 6, the general outward appearance of convertible shoe 1 in a low-heeled mode can best be seen.

Convertible shoe 1 has an upper 2, a sole assembly 8, and a lockable sliding shank assembly 12 (see FIG. 7), a shank locking means, a removable high heel 4, a removable low heel 6, and a heel locking means 14. Heels 4 and 6 are interchangeable and utilize the same locking means for securement to the shoe. Upper 2 is lasted may be affixed to sole assembly 8 as per conventional shoe fabrication methodology.

Lockable sliding shank assembly 12 includes a rigid shank 14, a track 16, and a shank locking means. Generally, these will each comprise a rigid material, such as a metal (e.g., steel) or a polymer. Looking at FIG. 9, it can be seen that shank 16 in this example is a linear, curved member, contoured for sliding operation tracing the arch of the specific shoe it is mated to. Although shank 16 may simply be a solid steel bent plate, in a preferred embodiment shank 16 is of a thinner fabrication and has a nonlinear axial cross section. This corrugated style configuration adds strength with a reduction in weight. Taking into consideration FIGS. 9, 10, and 11 together, it is understood that shank 16 has a central raised rib 20 flanked on either side by a depressed flange 22. Extending normally from the central rib 20 is the shank locking means, which in the preferred embodiment is a threaded stud 24 that threadingly engages the internal thread on locking lever 26. Locking lever 26 has a widened head with a flange 28 extending therefrom. In alternate embodiments there is a plethora of other styles and types of locking mechanisms that may be used with or separately from the lever.

Track 16 may take different structural configurations. However, in the preferred embodiment it resembles a "T" track. Depressed flanges 22 reside under the edges of track 16, and serve as the sliding contact interface between shank 14 and track 16. The track may be affixed in sole assembly 8 by gluing, stitching, mechanical fastening (see provided orifices 30), and/or the like. The ends of track 16 have caps 32, under which the distal or proximal ends of shank 14 reside when the shoe is in the high-heeled or low-heeled configuration. This mechanically prevents any separation between shank 14 and track 16 at their ends, functionally strengthening sliding shank assembly 12 during walking.

Figure 8:
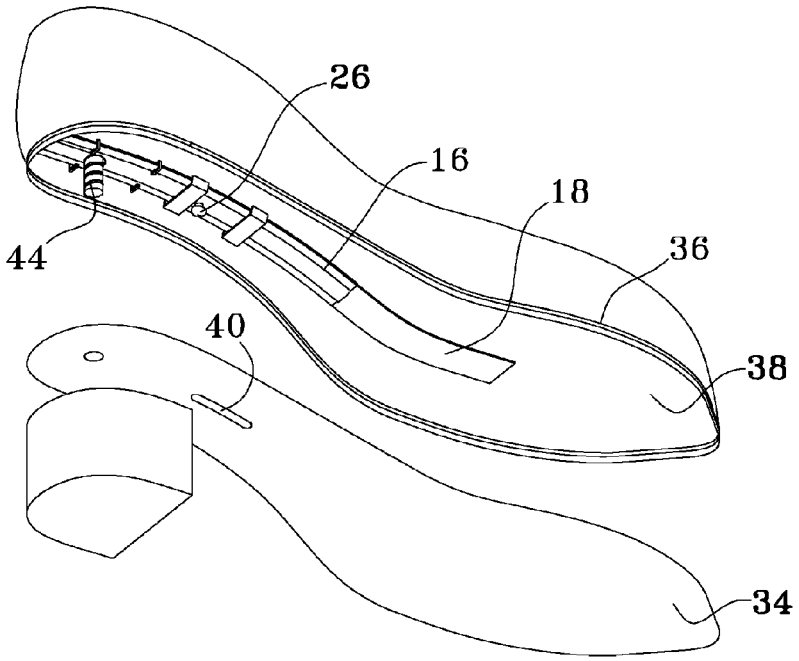
FIG. 8 is a bottom perspective exploded view of the convertible shoe in the low heeled mode.
Figure 9:
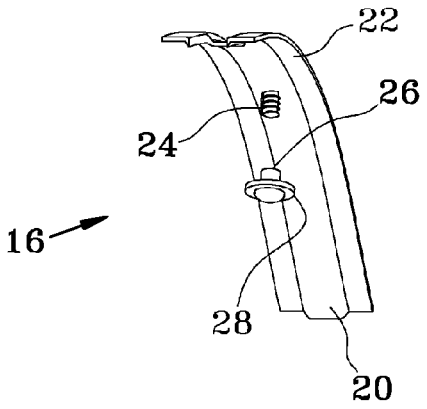
FIG. 9 is a front perspective of an illustrative sliding support shank showing a locking/adjustment lever.
Figure 10:
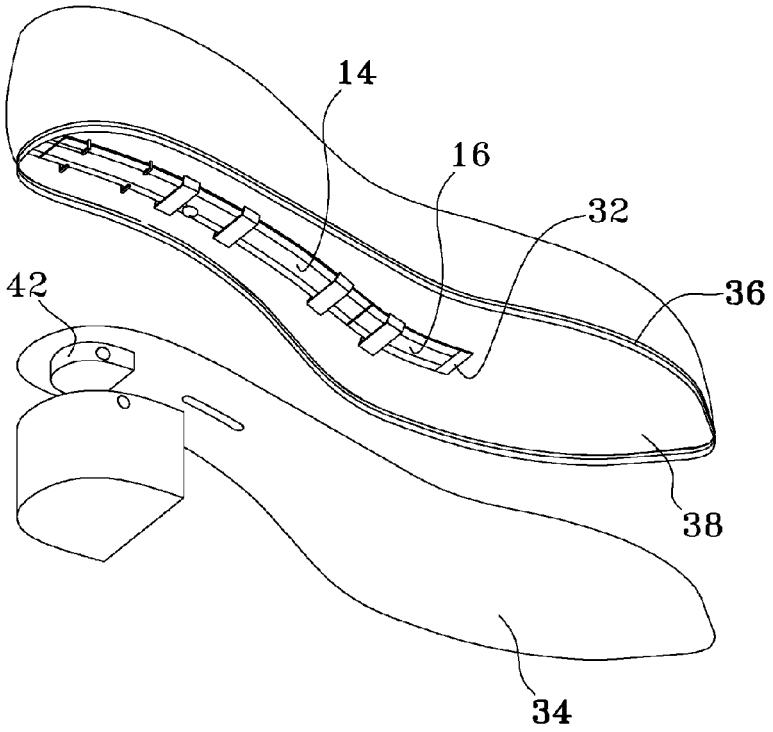
FIG. 10 bottom perspective exploded view of the convertible shoe in the low heeled mode with an alternate heel locking mechanism.
Figure 11:
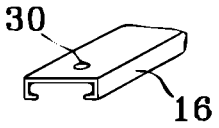
FIG. 11 is a perspective view of an illustrative support shank track.

Looking at FIG. 8, sole assembly 8 includes an outer sole 34 and an inner sole 36 bonded together, and may optionally contain a midsole 38 (or a welt) bonded on one of its faces to outer sole 34 and bonded on its other face to inner sole 36, so as to join the inner sole, midsole and outer sole into the sole assembly 8. In a preferred embodiment, track 16 and shank 14 reside in midsole 38, although as discussed herein, their placement will vary within sole assembly 8 depending on the shoe's design. Outer sole 34 has a slot 40 through which threaded stud 24 can pass to threadingly engage locking lever 26.

Sole assembly 8 may attach to either heel by any suitable method. Two such methods are discussed and illustrated herein. In a preferred embodiment (see FIG. 10) outer sole 34 has a raised detent 42 that conforms to a matingly conforming depression formed in the top of the heel. Both the heel and raised detent 42 have orifices therein that align upon assembly to accept a locking pin. In some embodiments (see FIG. 10), a threaded pin 44 that passes through an aligned orifice in outer sole 34 matingly engages a threaded recess in the heel. Similar style bayonet pins/fittings may be substituted.

In some embodiments, depending on the materials and design of sole assembly 8, track 16 may be eliminated and replaced by a groove 18 (see FIG. 8) partially or fully formed in the outsole, midsole, insole, or any combination thereof. This track will be sized to allow for the sliding, lockable movement of shank 14 therein. Generally the elimination of the track and substitution of a groove works well with thicker sole assemblies 8 made of very resilient materials.

In operation, the wearer selects the high-heel mode or the low-heel mode. If the low-heeled mode is desired, low heel 6 is affixed over raised detent 42, and a locking pin is inserted into the aligned orifices. Locking lever 26 is slid toward the back (heel side) of shoe 1. This causes shank 14 to slide in track 16 until the distal end of the shank reaches the distal end of track 16 and resides under the rear cap (not visible in the perspective drawings of FIGS. 8 and 10). Shank locking lever 26 is then screwed down tight such that its flange 28 frictionally engages outer sole 34, securing shank 14 in the low heel position. (Although it is to be noted that the action of walking, once the appropriate heel for the shank position button is installed, acts to keep the shank 14 in its position. The locking feature of lever 26 is a redundant feature and need not be utilized in all embodiments.) To switch to the high-heeled mode, the heels are swapped by the reverse process, lever 26 is unlocked and slid toward the front (toe side) of shoe 1, until the proximal end of shank 14 resides under front cap 32. Lever 26 is screwed tight.

The process as described for the low-heeled mode moves shank 26, resulting in the shoe's arch support shifting from under the metatarsophalangeal joints further back in shoe 1, under the calcaneus bone so as to allow more of the weight to be carried by the metatarsal bones and supporting the middle of the plantar fascia. Many styles of shoes incorporate the thickness of the sole into the design "look" and use platforms (thick midsoles), while other styles focus on minimalism and keep the sole to a minimal thickness, eliminating any midsoles. For this reason, although the preferred embodiment illustrates support shank track 16 and support shank 14 in midsole 38, they may alternately be located in insole 36 or outsole 34, or in any combination of the three sole parts.

In a similar manner, the system/mechanism for swapping the high and low heels will be dictated by the design of the shoe. While illustrated with a simple threaded centrally located pin 44, other suitable heel locking devices may be utilized (e.g., locking plates, dovetailed bases, moveable pins, bayonet fittings, and/or the like).

B. Second Illustrative Convertible Shoe

As shown in FIGS. 12-22, this section describes an illustrative convertible shoe 100. Shoe 100 is another example of the convertible shoe described in the Overview above.

Figure 12:
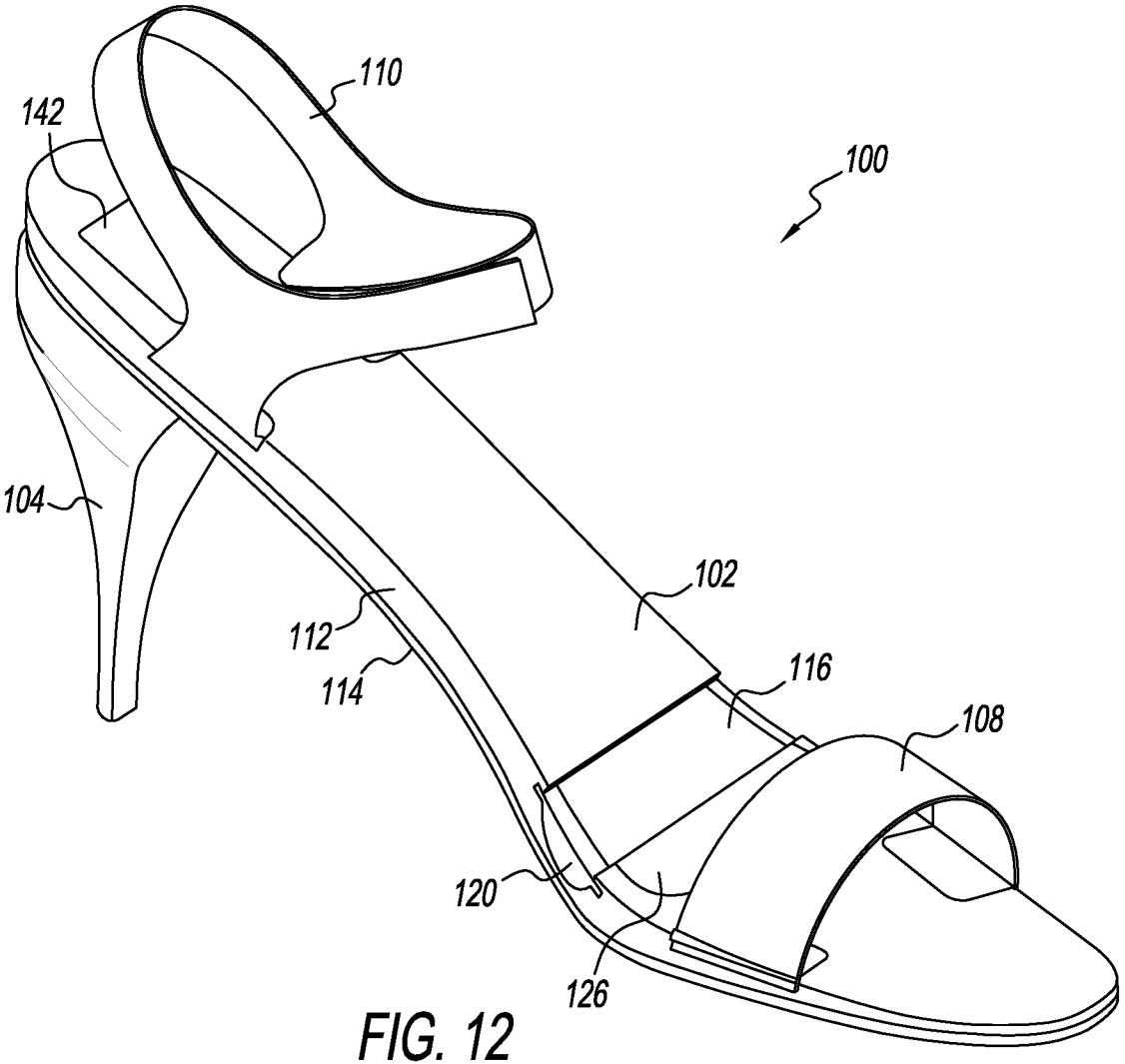
FIG. 12 is an isometric view of another illustrative convertible shoe in a high heeled mode.
Figure 13:
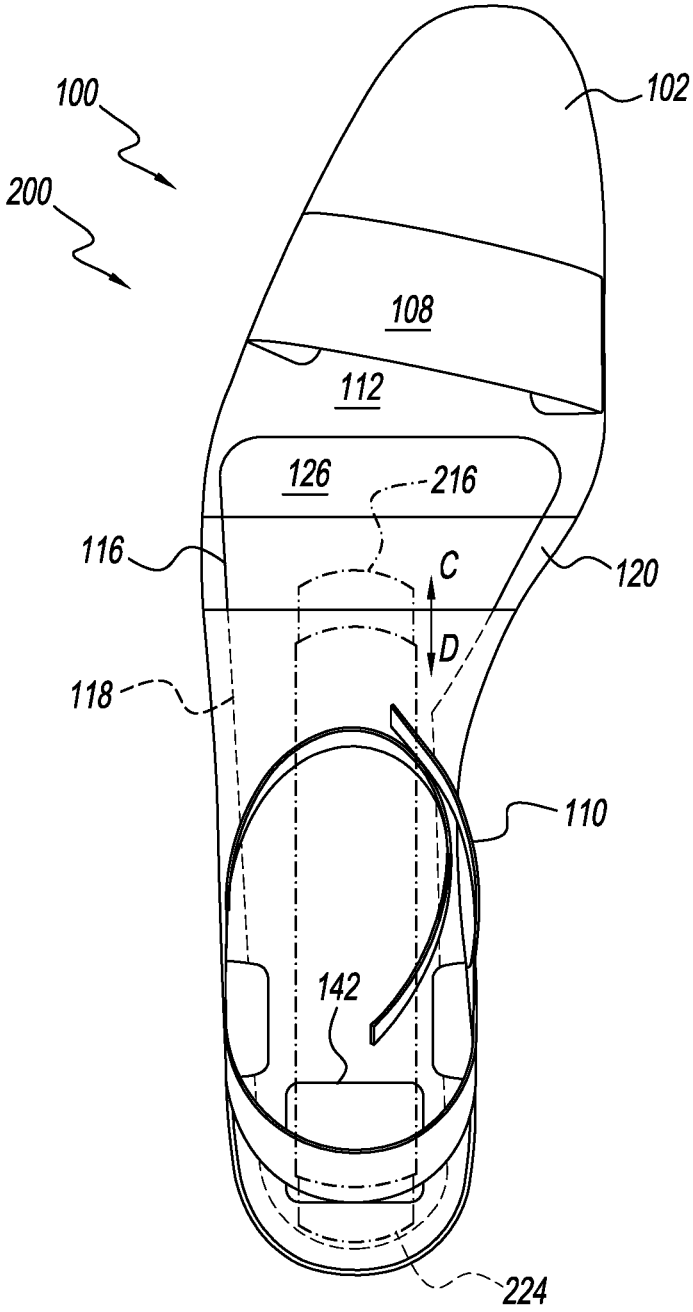
FIG. 13 is a top plan view of the shoe of FIG. 12.
Figure 14:
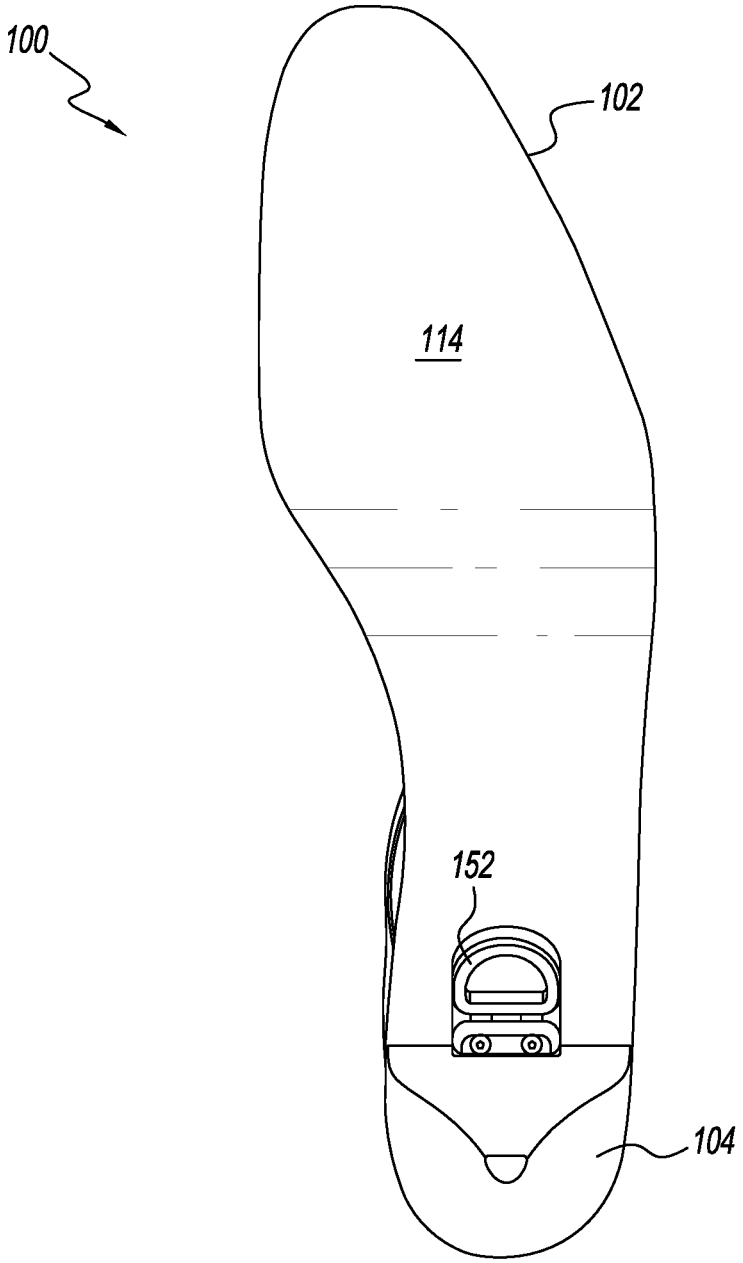
FIG. 14 is a bottom plan view of the shoe of FIG. 12.
Figure 15:
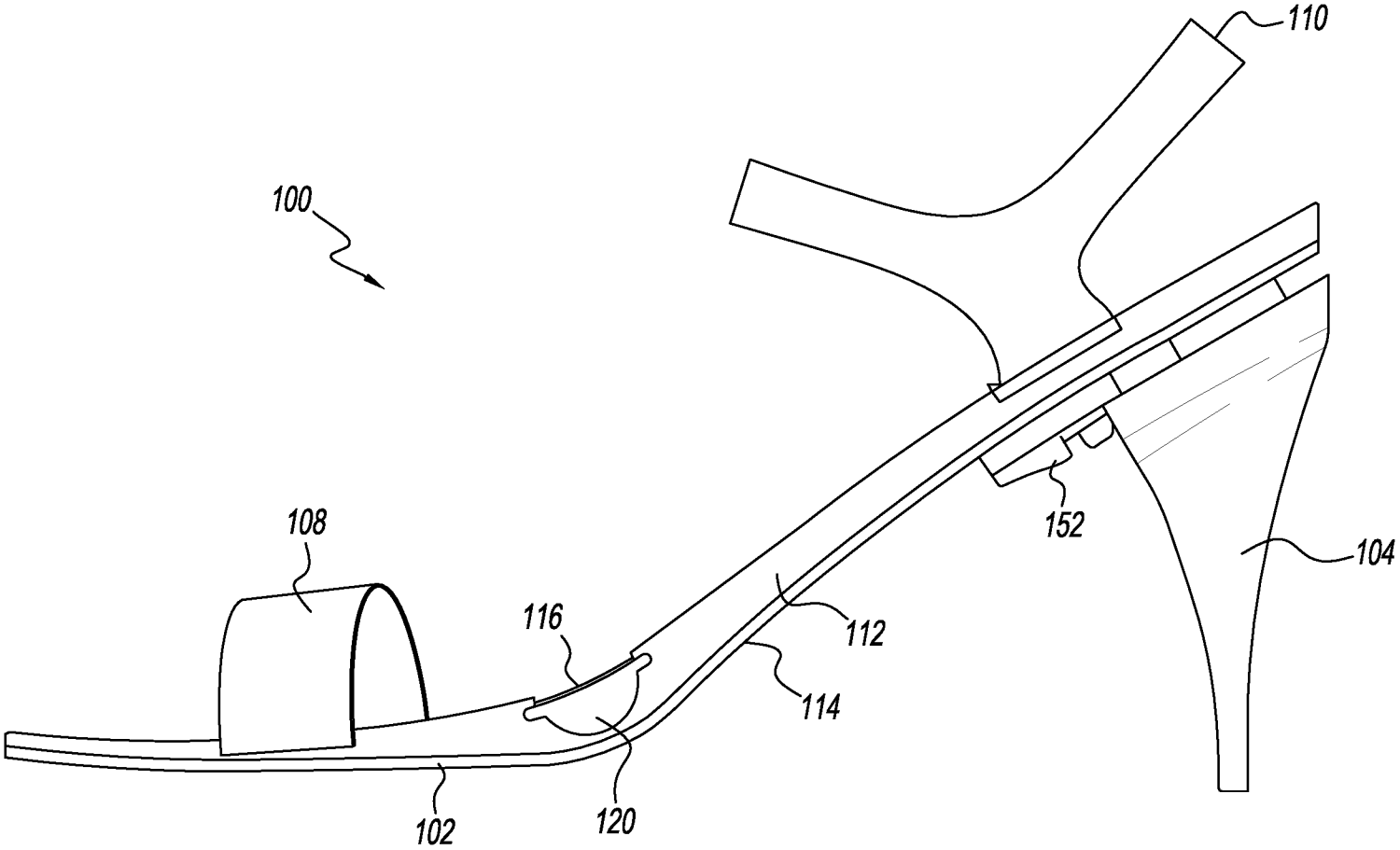
FIG. 15 is a left side elevation view of the shoe of FIG. 12.
Figure 16:
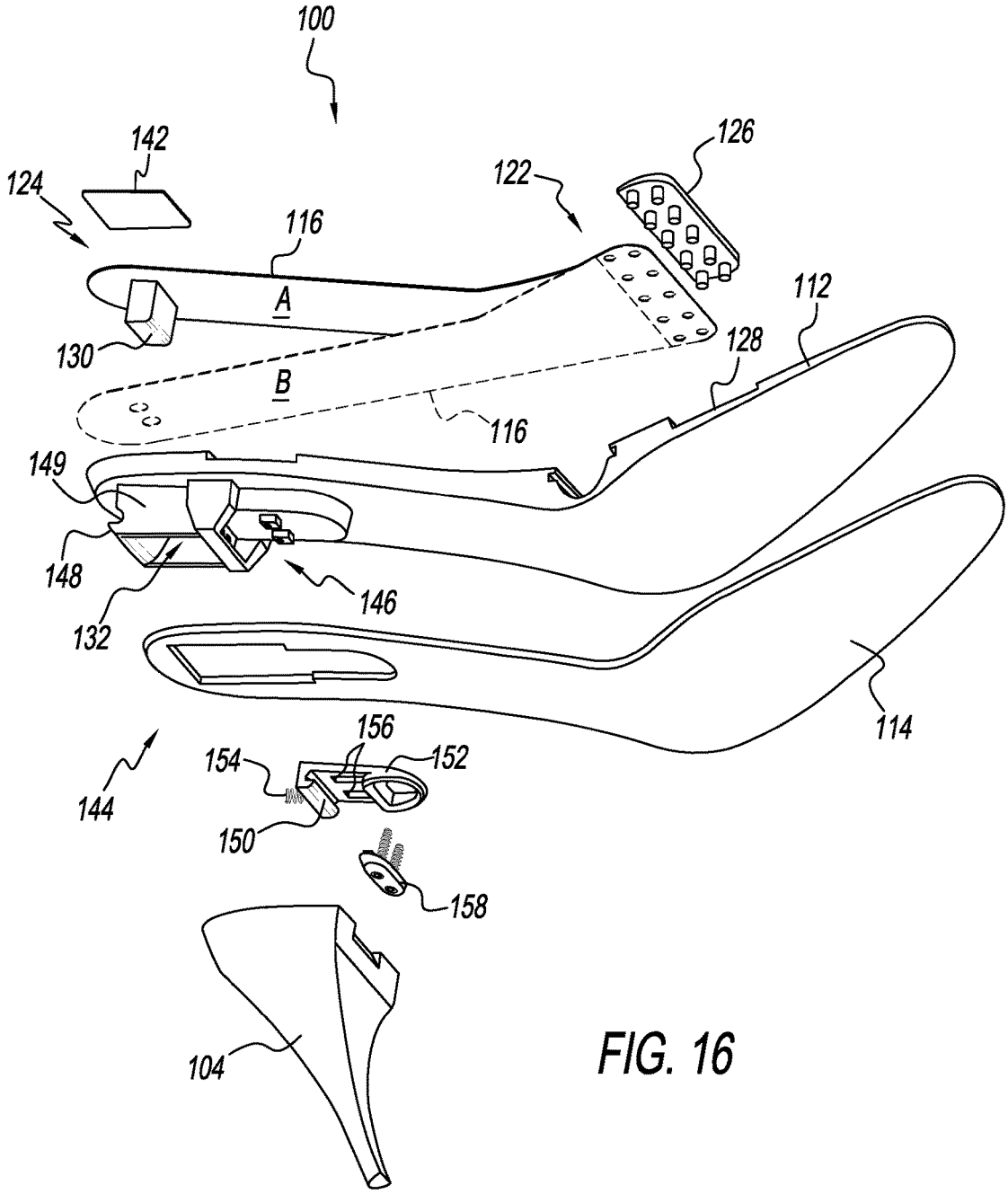
FIG. 16 is a first exploded view of the shoe of FIG. 12.
Figure 17:
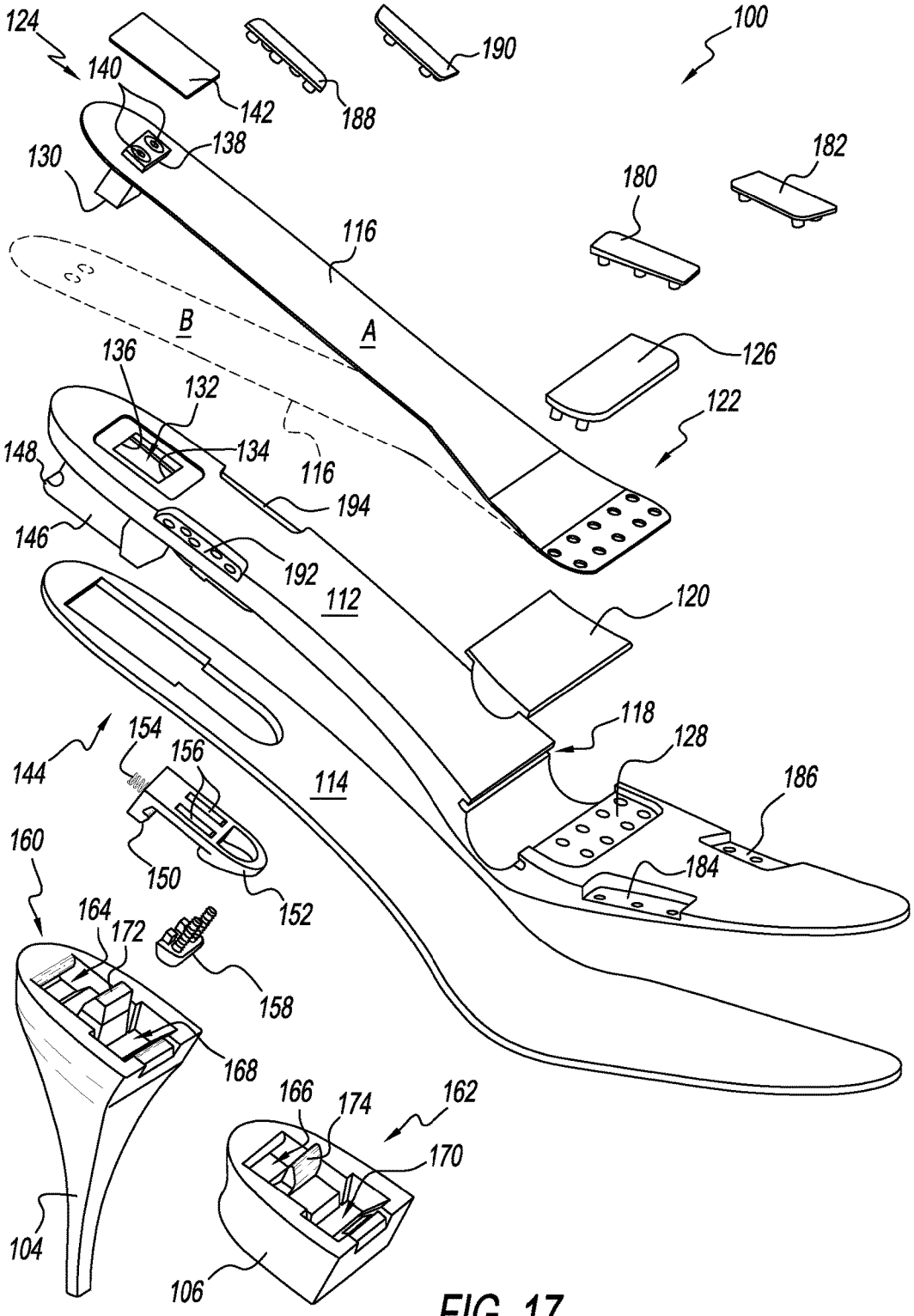
FIG. 17 is a second exploded view of the shoe of FIG. 12.
Figure 18:
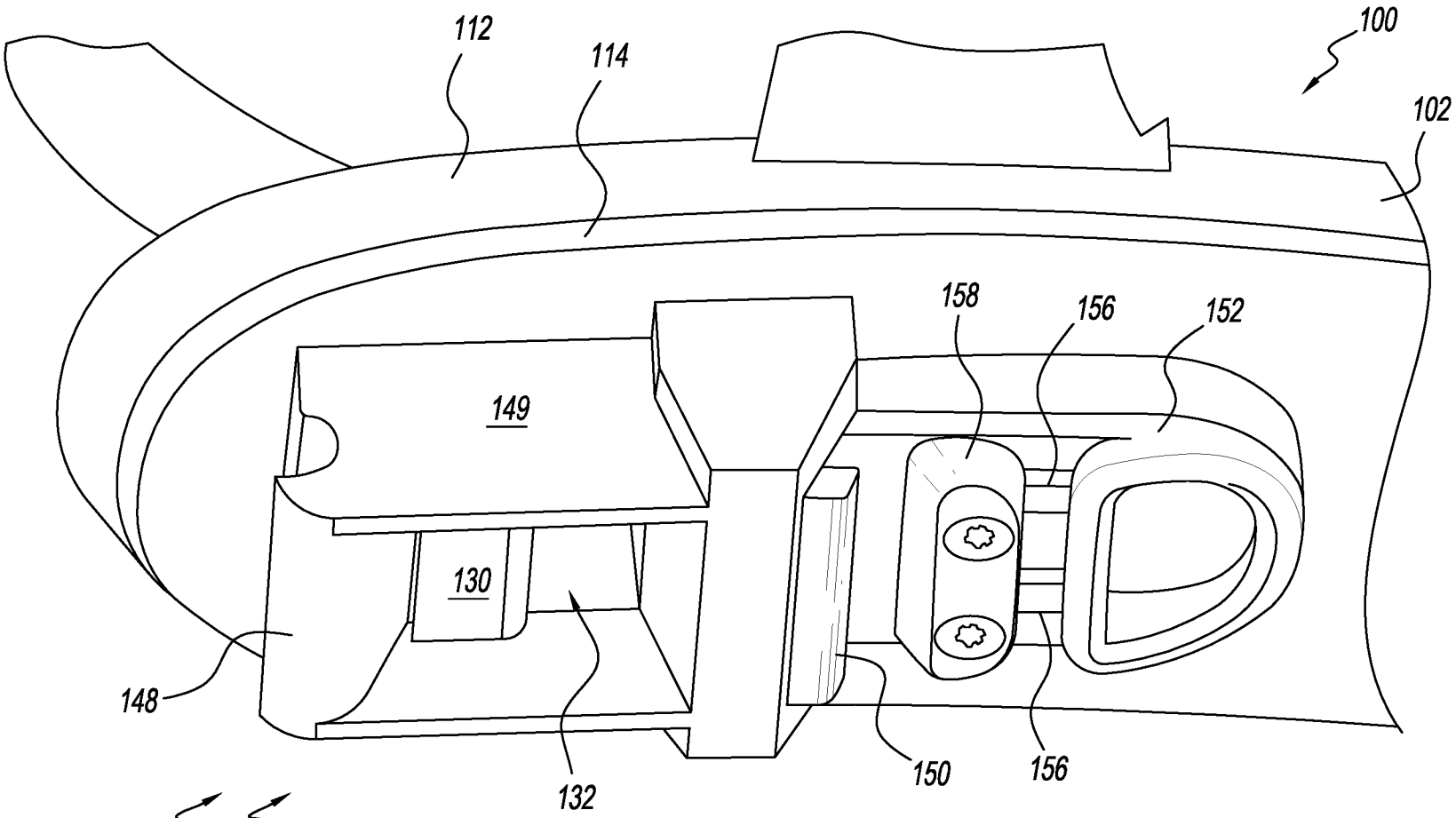
FIG. 18 is a magnified isometric view of a heel receiver portion of the shoe of FIG. 12.
Figure 19:
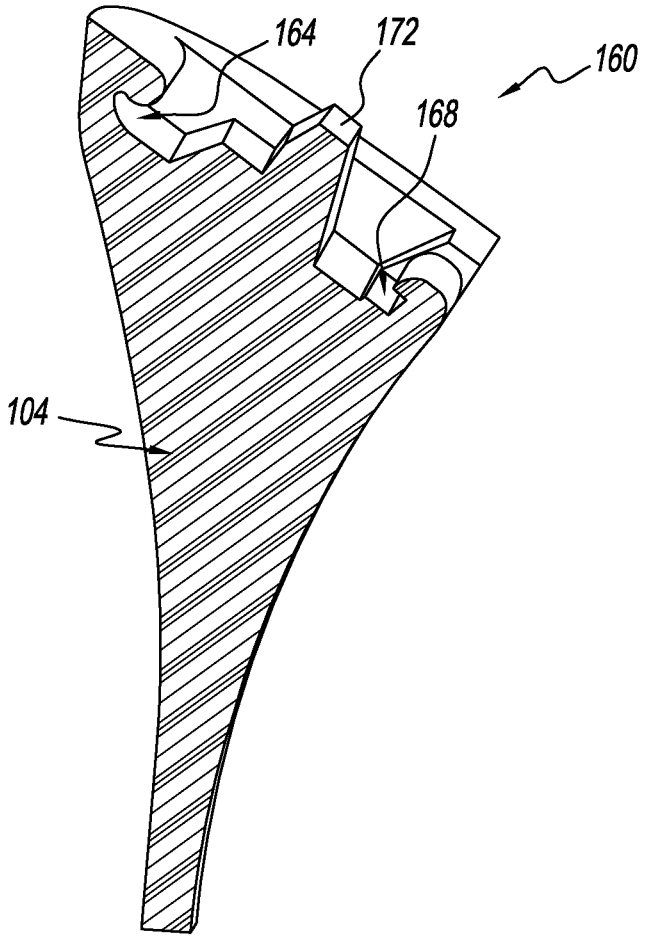
FIG. 19 is a sectional view of an illustrative high heel portion suitable for use with the shoe of FIG. 12.
Figure 20:
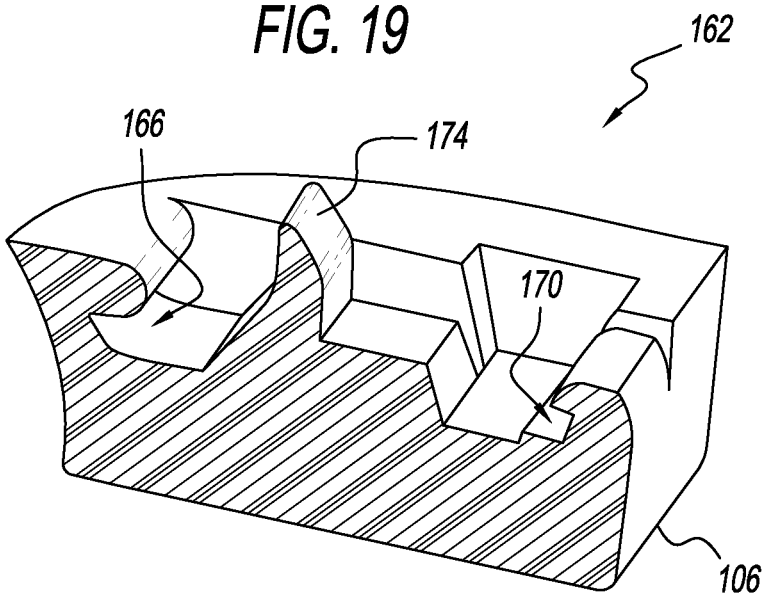
FIG. 20 is a sectional view of an illustrative low heel portion suitable for use with the shoe of FIG. 12.
Figure 21:
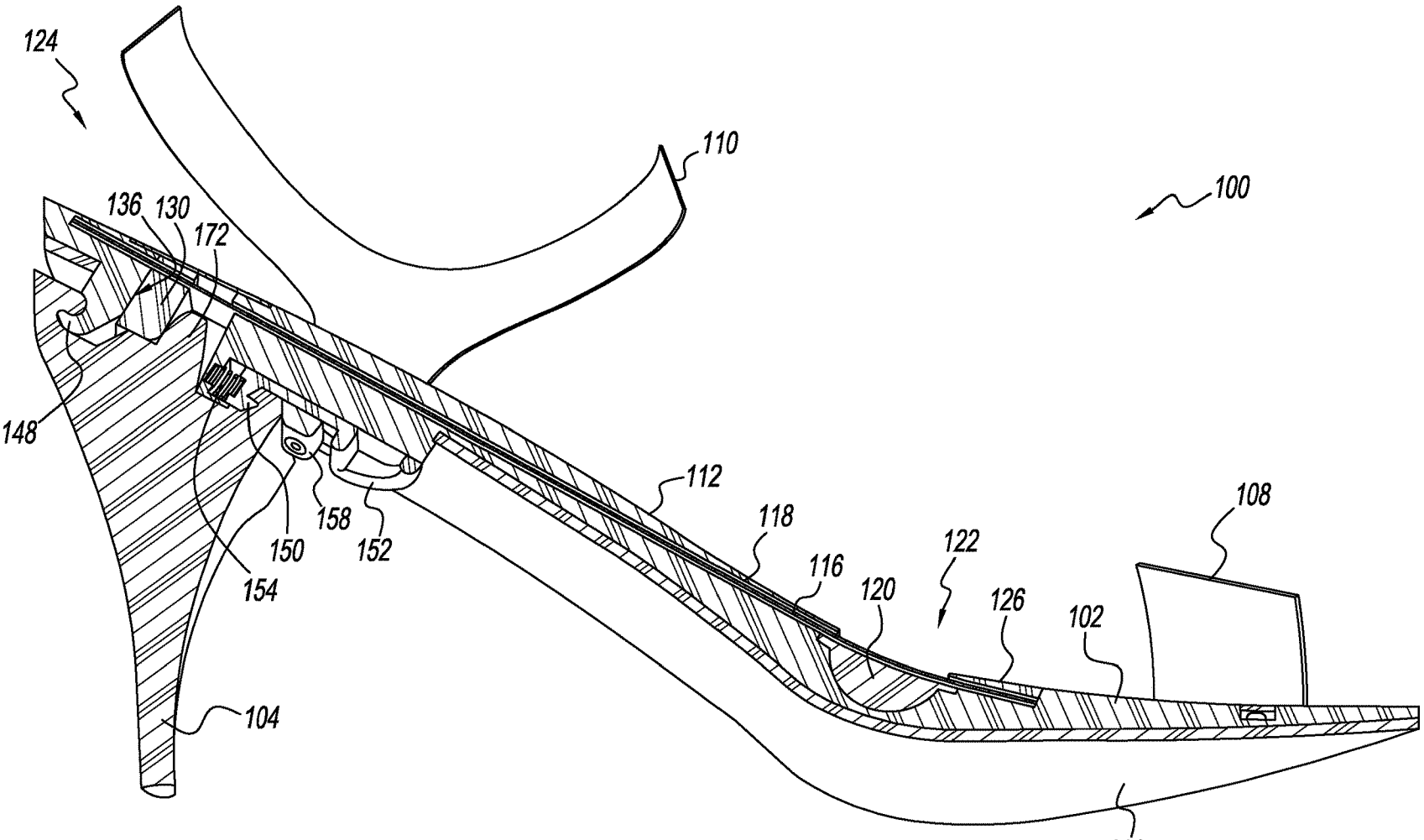
FIG. 21 is a sectional view of the shoe of FIG. 12, in the high heeled mode.
Figure 22:
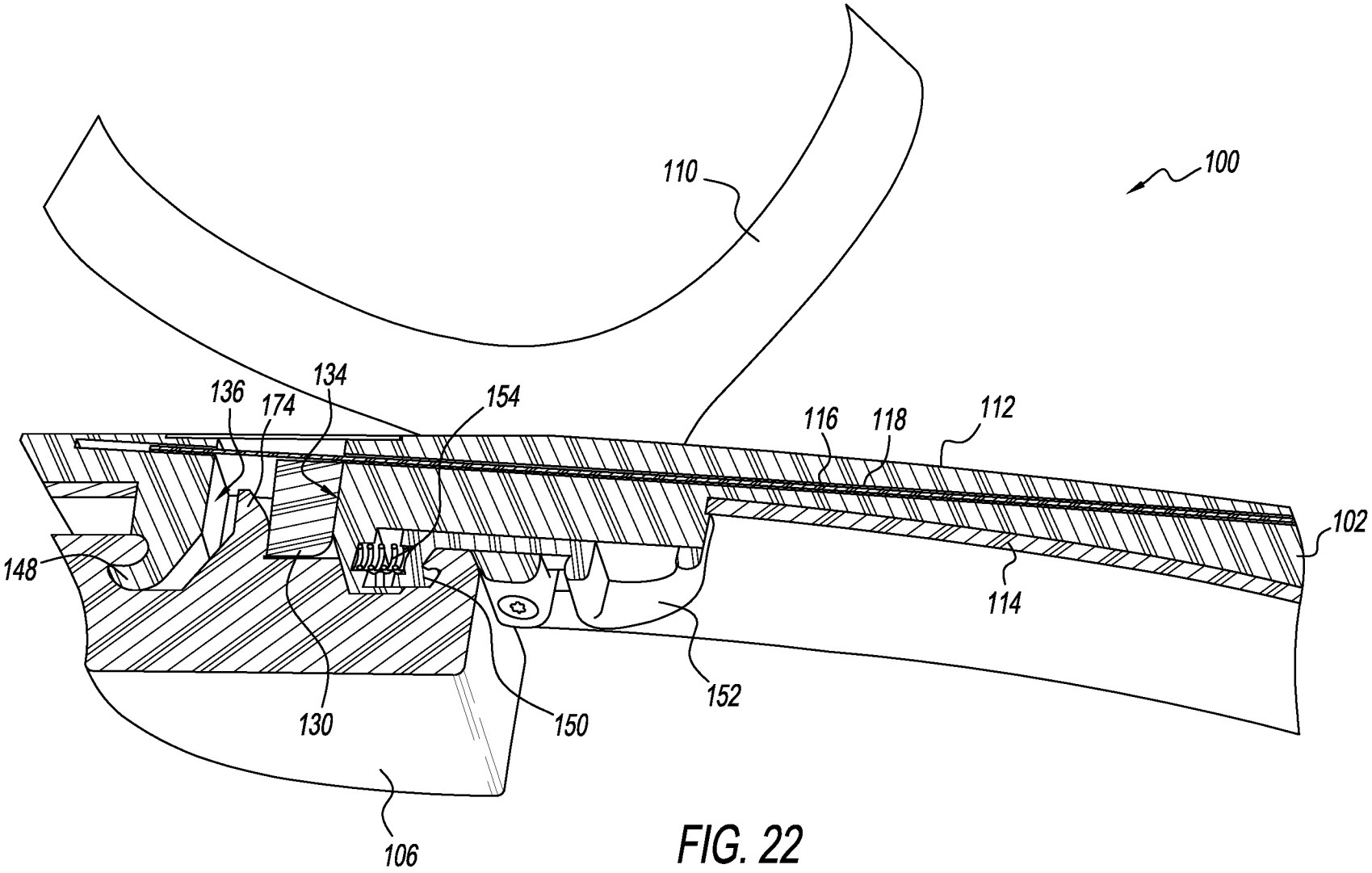
FIG. 22 is a partial sectional view of the shoe of FIG. 12, in a low heeled mode.

Shoe 100 is depicted in an orthogonal view in FIG. 12, a top plan view in FIG. 13, a bottom plan view in FIG. 14, and a side view in FIG. 15. FIGS. 16 and 17 depict exploded views of various components of shoe 100. FIG. 18 is a magnified view of a heel receiver portion of the shoe, and FIGS. 19 and 20 are sectional views of two different heel portions suitable for use with shoe 100. FIG. 21 is a sectional view of the assembled shoe, showing how the heel portion of FIG. 19 attaches to the heel receiver, and FIG. 22 is a partial sectional view showing a similar connection between the heel portion of FIG. 20 and the heel receiver. Although this example refers to a shoe, the features of the present disclosure can be used with any suitable article of footwear, e.g., boots, shoes, sandals, etc.

Shoe 100 includes a sole 102 and a number of interchangeable heel portions that are releasably securable to the sole. In the present example, shoe 100 includes a high heel portion 104 and a low heel portion 106, also referred to as a tall heel portion and a short heel portion, respectively. Shoe 100 may also include an upper, as described above with respect to shoe 1, or any other suitable portion configured to hold a foot of the user. For example, shoe 100 includes a toe strap 108 and a heel strap 110, affixed to the sole and optionally adjustable to fit the foot. More or fewer straps may be utilized.

Sole 102 includes an insole portion 112 generally layered atop an outsole portion 114. As described above, the insole and outsole may comprise any suitable materials, and may be affixed together using known methods. In some examples, however, sole 102, including both insole portion 112 and outsole portion 114, may be generated in a single process, such as multi-material 3-D printing, in which the sole is built in an additive manufacturing process. In general, outsole portion 114 may include a tougher, less resilient material than insole portion 112, e.g., for wear-resistance. Insole portion 112 may include a softer, more resilient material, e.g., for comfort. In some examples, sole 102 may include more or fewer layers.

A support shank 116 is housed at least partially within a pocket or cavity 118 formed in sole 102. Because the support shank and sole may be made of different materials, and because relative movement between the support and the sole may be desirable, support shank 116 and sole 102 are at least partially movable relative to each other. In other words, at least some portion (in some examples, the entirety) of the support shank is free to slide longitudinally with respect to the sole. In some embodiments, it may be more useful to consider that the sole is at least partially free to move with respect to the support shank, as described further below. Support shank 116 is analogous to support shank 14, described above, and has similar functionality. Support shank 116 may include any suitable materials, such as steel (e.g., spring steel). In the present example, support shank 116 may have a degree of flexibility rather than being completely rigid. This is best seen in FIGS. 16 and 17, where an example of a high-heel configuration A and a low-heel configuration B of the support are both depicted.

In this example, cavity 118 is formed entirely in insole portion 112, as best indicated in FIG. 21. However, other suitable configurations may be utilized. For example, cavity 118 may be formed between insole 112 and outsole 114, or partially in each. Shoe 100 further includes an flexible insert portion 120, which lies under support shank 116 proximate a bend in shoe 100 where additional flex and softer support may be needed for the ball of the foot.

In the example of shoe 100, a front end portion 122 of support 116 is secured to sole 102, such that a longitudinal position of the front end portion of the support shank is fixed relative to the sole. A rear end portion 124 of the support remains freely movable within cavity 118. Front end portion 122 of support 116 may be secured by any suitable structure or device. Here, a clamp plate 126 is utilized to secure front end portion 122 to a clamp plate receiver 128 of insole 112.

As depicted, for example, in FIG. 17, a plurality of pins in clamp plate 126 pass through corresponding apertures in front end portion 122 and into receiving holes in receiver 128 to secure the support to the insole. Alternatively or additionally, other securing methods may be utilized, such as adhesives, bonding, and/or the like. As described, for example, in Sections A and C, some embodiments of the convertible shoes described herein do not include securing front end portion 122 to sole 102 (i.e., in some examples, the entire support shank is movable in a longitudinal direction relative to the sole).

In similar fashion, toe strap 108 and heel strap 110 may be secured to sole 102 using any suitable method or device. In this example, toe strap 108 is secured to sole 102 by clamping (and/or adhering, bonding, etc.) the ends of the strap between clamp plates 180, 182 and corresponding clamp plate receivers 184, 186, as shown in FIG. 17. Likewise, heel strap 110 is secured to sole 102 by clamping (and/or adhering, bonding, etc.) the ends of the strap between clamp plates 188, 190 and corresponding clamp plate receivers 192, 194.

A block 130 is affixed to rear end portion 124 of support shank 116, extending generally downward through an opening or aperture 132 in sole 102. As depicted in the drawings, block 130 is substantially cuboidal. However, block 130 may have any suitable shape and/or size. Aperture 132 is larger than the block, at least in a longitudinal dimension, such that block 130 can move longitudinally from a front side 134 of the aperture to a rear side 136 of the aperture. This longitudinal dimension may be selected to determine the limits of such movement, and thereby to determine the limits of movement of the support relative to the sole.

Block 130 may be secured to support shank 116 using any suitable structure or device. In this example, support 116 is held between a clamp plate 138 and block 130, and fastened using a pair of screws 140, e.g., as shown in FIG. 17. An access plate 142 is used to cover the opening in sole 102 above this portion of the support shank and prevent interference and discomfort with respect to the user's foot. In general, a function of block 130 is to interface with a corresponding feature of the heel portion to establish and/or secure the longitudinal position of the support shank relative to the sole. As best shown in FIG. 22, when shoe 100 is converted to a low-heel configuration, sole 102 extends rearward slightly with respect to support shank 116, which is secured at its front end. This leaves an empty space at the back end of cavity 118. Block 130 and the heel portion interact to secure this arrangement and prevent further movement. As described further in Section C, block 130 has similar functionality when support shank 116 is free at both ends, in that embodiment both repositioning and securing the support with respect to the sole.

A heel attachment mechanism 144 is included in shoe 100, comprising features of the heel portion as well as of the sole. Heel attachment mechanism 144 may include any suitable structure and/or device configured to releasably secure the heel portion to the sole. For example, one or more of the heel attachment mechanisms described in Section A may be used with shoe 100. In this example, heel attachment mechanism 144 includes a heel receiver 146 attached to sole 102. Heel receiver 146 may be affixed to sole 102 using any suitable method, and in this example is formed as a part of sole 102 (e.g., as a part of insole 112 extending downward through outsole 114. Specifically, heel receiver includes a fixed hook portion 148 which extends from a base 149 of the heel receiver, a movable hook portion 150 disposed opposite the fixed hook portion, and an actuator 152 configured to move the movable hook portion between a retracted position and an extended position.

Hook portions 148 and 150 may be oriented in any direction, e.g., with the fixed hook facing forward, left, right, or rearward, and the movable hook facing in the opposite direction. Here, fixed hook portion 148 faces toward the rear, and movable hook portion 150 faces toward the front of the shoe. Movable hook portion 150 is biased toward the extended, or forward, position. Any suitable biasing device may be used. Here, a coil spring 154 is used, as shown in FIGS. 16, 17, 21, and 22.

Actuator 152 is connected to movable hook portion 150, such that operation (e.g., manual operation) of actuator 152 against the biasing force of spring 154 causes the movable hook to retract. In the example shown in the drawings, actuator 152 is of a single piece with movable hook portion 150, and has a pair of channels 156 that permit longitudinal sliding of the actuator, as guided by the screws and/or guidepins of a retainer plate 158 that holds the actuator and movable hook against a bottom surface of the heel receiver base.

Heel portions 104 and 106 each include an upper mounting surface, namely upper mounting surface 160 and upper mounting surface 162, respectively, for attaching the heel portion to the heel receiver. Each of these upper mounting surfaces includes a first recess 164, 166 configured to engage fixed hook portion 148 and a second recess 168, 170, configured to engage movable hook portion 150, such that, when the heel portion is engaged with the heel receiver, the heel portion is secured to the heel receiver when the movable hook portion is in the extended position and the heel portion is releasable from the heel receiver when the movable hook portion is in the retracted position.

As shown in the drawings, aperture 132 extends through sole 102 between fixed hook portion 148 and movable hook portion 150. More specifically, aperture 132 passes in a generally vertical direction through the sole and through base 149, forming a walled channel or passageway.

Each of upper mounting surfaces 160 and 162 further includes an upward-protruding wedge, namely wedge 172 of high heel portion 104 and wedge 174 of low heel portion 106. Each of these wedges is configured to penetrate aperture 132 and interface with block 130, albeit in a different manner. Specifically, installing a heel portion onto the heel receiver causes wedge 172 or 174 to abut a forward or rear face of block 130, forcing block 130 in a selected longitudinal direction. When installed, the geometric relationship of wedges 172 and 174 relative to aperture 132 determines whether block 130 is wedged against front side 134 or rear side 136 of aperture 132. In other words, the fore-and-aft position of the upward-protruding wedge on the heel portion determines the direction in which it applies force to block 130, locking the block between the wedge and the wall of the aperture. In this example, wedge 172 of high heel portion 104 sits further forward on mounting surface 160 than wedge 174 of low heel portion 106 does on mounting surface 162. Accordingly, with shoe 100, installing high heel portion 104 will lock block 130 against rear side 136 of aperture 132. Similarly, installing low heel portion 106 will lock block 130 against front side 134 of aperture 132.

In operation, shoe 100 may be converted between two or more interchangeable heels as follows. Starting with sole portion 102 having no heel attached, upper mounting surface 160 of high heel portion 104 may be placed into engagement with heel receiver 146. Specifically, heel portion 104 may be placed at an angle such that fixed hook 148 inserts into rear hook-receiving recess 164 and engages therein. The heel portion may then be pivoted upward, such that movable hook 150 comes into contact with the upper mounting surface, forcing the movable hook to retract against spring 154 and allowing the heel portion to fully engage the heel receiver. Once fully engaged, spring 154 will force movable hook 150 to extend into front hook-receiving recess 148. This may be experienced by the user as the heel "snapping" into place. If necessary, actuator 152 may be utilized to aid in the process of retracting and/or extending movable hook 150. Furthermore, support shank 116 and block 130 may require manual positioning before or during full engagement of the heel portion with the heel receiver, to permit proper engagement of wedge 172 with block 130. In some examples, wedge 172 automatically positions block 130 and therefore support shank 116. FIG. 21 shows how the various components relate to each other when high heel portion 104 is installed on shoe 100.

Reversing the process to remove high heel portion 104, actuator 152 is manipulated rearward to retract movable hook 150, permitting disengagement of the front side of the heel portion. Heel portion 104 can then be pivoted and removed from fixed hook 148, thereby removing the heel portion altogether.

Similarly, low heel portion 106 can then be installed by placing upper mounting surface 162 of low heel portion 106 into engagement with heel receiver 146. Specifically, heel portion 106 may be placed at an angle such that fixed hook 148 inserts into rear hook-receiving recess 166 and engages therein. The heel portion may then be pivoted upward, such that movable hook 150 comes into contact with the upper mounting surface, forcing the movable hook to retract against spring 154 and allowing the heel portion to fully engage the heel receiver. Once fully engaged, spring 154 will force movable hook 150 to extend into front hook-receiving recess 170. Again, if necessary, actuator 152 may be utilized to aid in the process of retracting and/or extending movable hook 150. As above, support shank 116 and block 130 may require manual positioning before or during full engagement of the heel portion with the heel receiver, to permit proper engagement of wedge 174 with block 130. In some examples, wedge 174 automatically positions block 130 and therefore support shank 116. FIG. 22 shows how various components relate to each other when low heel portion 106 is installed on shoe 100.

Although a high heel and a low heel are described in the various embodiments herein, any combination of heights, whether different or the same, may be used. For example, shoe 100 may be convertible between similar as well as different heel heights. For example, two high heels, one slightly higher than the other, may be included with sole 102, and both may include an upward-protruding wedge substantially similar to wedge 172.

C. Third Illustrative Convertible Shoe

Figure 23:
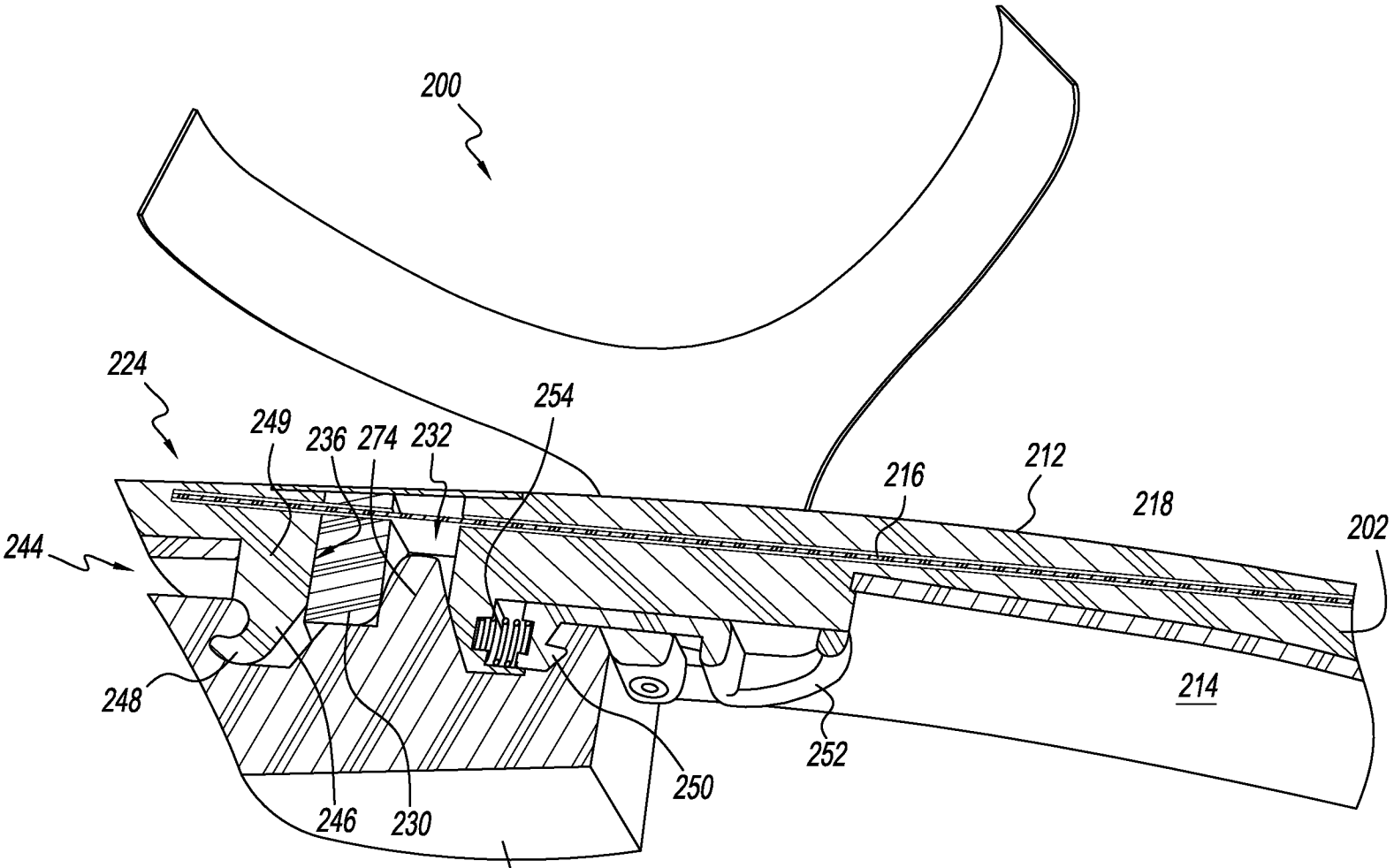
FIG. 23 is a partial sectional view of another illustrative convertible shoe in a low heeled mode.
Figure 24:
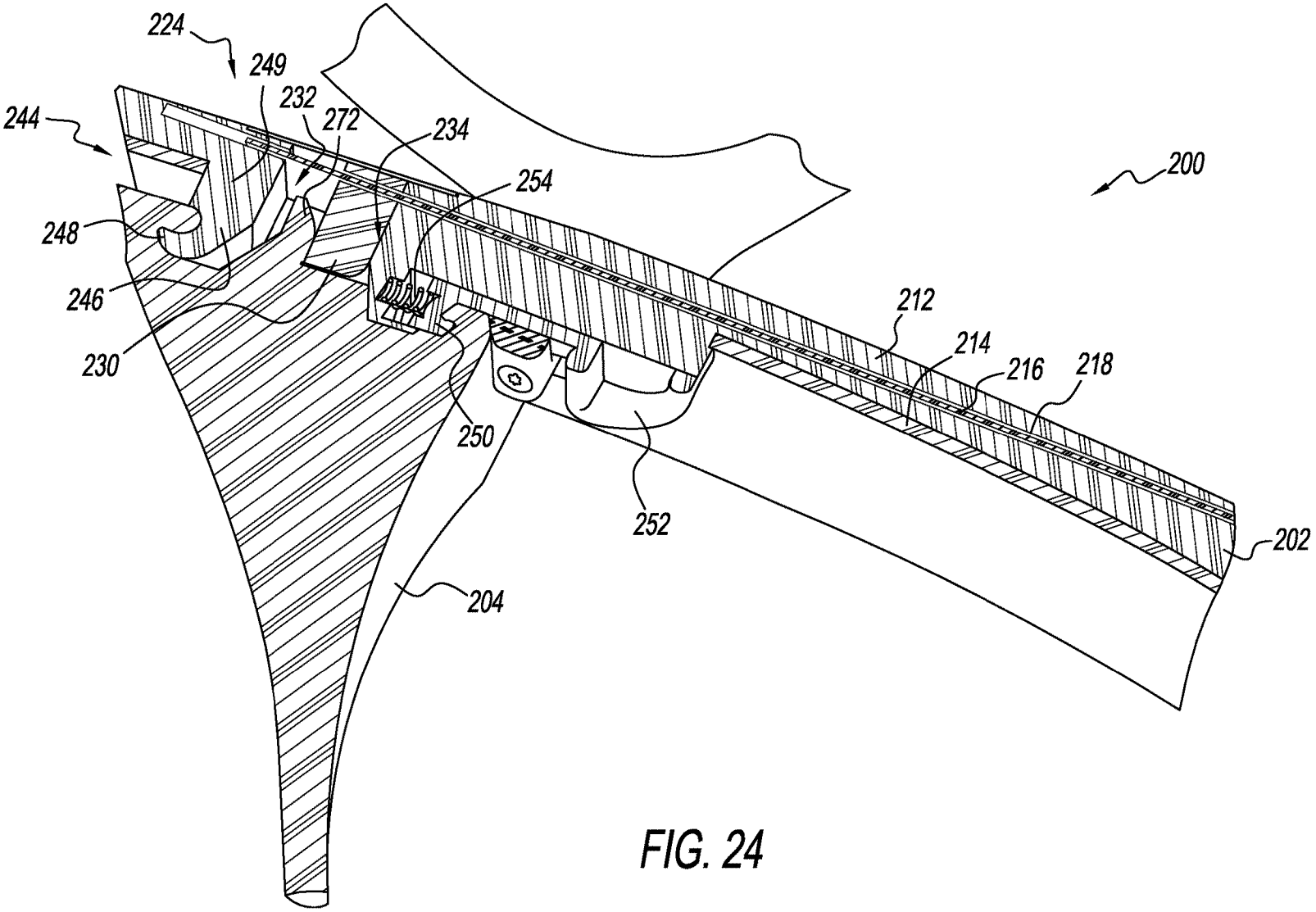
FIG. 24 is a partial sectional view of the shoe of FIG. 23 in a high heeled mode.

As shown in FIGS. 13, 23, and 24, this section describes an illustrative convertible shoe 200. Shoe 200 is another example of the convertible shoe described in the Overview above, having selected characteristics of shoe 1 and of shoe 100, as further described below. FIG. 13 is an overhead view of shoe 100 (see Section B), showing where an illustrative support shank may be positioned on shoe 200, which is substantially identical to shoe 100 in this view otherwise. FIG. 23 is a partial sectional view showing a low heel installed on shoe 200, and FIG. 24 is a partial sectional view showing a high heel installed on shoe 200.

In general, shoe 200 is substantially identical to shoe 100, other than with respect to the support shank and the upward protruding wedges of the heel portions. Regarding operation of the support shank, shoe 200 may be regarded as more similar to shoe 1, in that the entirety of the support shank is longitudinally movable with respect to the sole, with its attendant advantages.

Specifically, shoe 200 includes a sole 202 and a number of interchangeable heel portions that are releasably securable to the sole (e.g., a high heel portion 204 and a low heel portion 206). As with shoe 100, shoe 200 may include an upper or any other suitable portion configured to hold a foot of the user.

Sole 202 may be unitary, but in this example includes an insole portion 212 generally layered atop an outsole portion 214. More or fewer layers may be included.

A support shank 216 is housed at least partially within a pocket or cavity 218 formed in sole 202. As with shoe 100, support shank 216 and sole 202 are at least partially movable relative to each other. In this example, the entirety of the support shank is free to slide longitudinally with respect to the sole, within limits. With reference to FIG. 13, an example of support shank 216 is depicted in a forward position C and a rearward position D.

In this example, cavity 218 is formed entirely in insole portion 212. However, other suitable configurations may be utilized. For example, cavity 218 may be formed between insole 212 and outsole 214, or partially in each. In the example of shoe 200, the entire support shank is movable in a longitudinal direction within cavity 218, relative to the sole.

A block 230 is affixed to a rear end portion 224 of support shank 216, extending generally downward through an opening or aperture 232 in sole 202. Block 230 and aperture 232 are substantially identical to corresponding block 130 and aperture 132 of shoe 100. As described above, block 230 can move longitudinally from a front side 234 of the aperture to a rear side 236 of the aperture. A longitudinal dimension between front side 234 and rear side 236 may be selected to determine the limits of such movement, and thereby to determine the limits of movement of the support relative to the sole.

As shown in FIG. 23, when shoe 200 is converted to a low-heel configuration, support shank 216 is shifted rearward within cavity 218, into position D. Block 230 and the heel portion interact to secure this arrangement and prevent further movement. As described further below, this interaction both repositions and secures the support with respect to the sole.

A heel attachment mechanism 244 is included in shoe 200, and is substantially identical to heel attachment mechanism 144, described above. As mentioned in Section B, one or more of the heel attachment mechanisms described in Section A may be used with shoe 200. However, in this example, heel attachment mechanism 244 includes a heel receiver 246 attached to sole 202. As described with respect to heel receiver 146, heel receiver 246 includes a fixed hook portion 248 which extends from a base 249 of the heel receiver, a movable hook portion 250 disposed opposite the fixed hook portion, and an actuator 252 configured to move the movable hook portion between a retracted position and an extended position. All of the components of heel receiver 246 are substantially identical to those of heel receiver 146, and movable hook portion 250 is again biased toward the extended, or forward, position by a coil spring 254.

Heel portions 204 and 206 each include an upper mounting surface for attaching the heel portion to the heel receiver. Each of these upper mounting surfaces is substantially similar to the upper mounting surfaces of heel portions 104 and 106, with the exception of the placement of the upward-protruding wedges. Accordingly, each heel portion includes a first (front) recess and a second (rear) recess for engaging the fixed and movable hooks of heel receiver 246. However, a wedge 272 of high heel portion 204 and a wedge 274 of low heel portion 206 are positioned differently than their corresponding components in shoe 100. Each of these wedges is again configured to penetrate aperture 232 and interface with block 230. Installing a heel portion onto the heel receiver again causes wedge 272 or 274 to abut a forward or rear face of block 230, forcing block 230 in a selected longitudinal direction. In this example, wedge 272 of high heel portion 204 sits further rearward on the mounting surface than wedge 274 of low heel portion 206 does on its mounting surface. Accordingly, with shoe 200, installing high heel portion 204 will position and lock block 230 against rear side 236 of aperture 232. Similarly, installing low heel portion 206 will position and lock block 230 against front side 234 of aperture 232.

In operation, shoe 200 may be converted between two or more interchangeable heels as follows. Starting with sole portion 202 having no heel attached, the upper mounting surface of high heel portion 204 may be placed into engagement with heel receiver 246. Specifically, heel portion 204 may be placed at an angle such that fixed hook 248 inserts into the rear hook-receiving recess and engages therein. The heel portion may then be pivoted upward, such that movable hook 250 comes into contact with the upper mounting surface, forcing the movable hook to retract against spring 254 and allowing the heel portion to fully engage the heel receiver. Once fully engaged, spring 254 will force movable hook 250 to extend into the front hook-receiving recess. This may again be experienced by the user as the heel "snapping" into place. If necessary, actuator 252 may be utilized to aid in the process of retracting and/or extending movable hook 250. Furthermore, support shank 216 and block 230 may require manual positioning before or during full engagement of the heel portion with the heel receiver, to permit proper engagement of wedge 272 with block 230. In other words, the user may manually force block 230 forward in aperture 232 before installing the heel. In some examples, wedge 272 automatically positions block 230 and therefore support shank 216. FIG. 24 shows how various components relate to each other when high heel portion 204 is installed on shoe 200.

Reversing the process to remove high heel portion 204, actuator 252 is manipulated rearward to retract movable hook 250, permitting disengagement of the front side of the heel portion. Heel portion 204 can then be pivoted and removed from fixed hook 248, thereby removing the heel portion altogether.

Similarly, low heel portion 206 can then be installed by placing the upper mounting surface of low heel portion 206 into engagement with heel receiver 246. Specifically, heel portion 206 may be placed at an angle such that fixed hook 248 inserts into the rear hook-receiving recess and engages therein. The heel portion may then be pivoted upward, such that movable hook 250 comes into contact with the upper mounting surface, forcing the movable hook to retract against spring 254 and allowing the heel portion to fully engage the heel receiver. Once fully engaged, spring 254 will force movable hook 250 to extend into the front hook-receiving recess. As above, support shank 216 and block 230 may require manual positioning before or during full engagement of the heel portion with the heel receiver, to permit proper engagement of wedge 274 with block 230. In other words, the user may manually force block 230 rearward in aperture 232 before installing the heel. In some examples, wedge 274 automatically positions block 230 and therefore support shank 216 (i.e., into rearward position D). FIG. 23 shows how various components relate to each other when low heel portion 206 is installed on shoe 200.

D. Illustrative Combinations and Additional Examples

This section describes additional aspects and features of convertible footwear of the present teachings, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. An article of footwear comprising:

a sole including a heel receiver;

a support shank housed within the sole, wherein the support shank and the sole are at least partially movable relative to each other;

a block affixed to a rear portion of the support shank and passing generally downward through an aperture in the sole proximate the heel receiver, a longitudinal dimension of the aperture being larger than the block;

a first heel portion having a first wedge protruding generally upward from the first heel portion; and a second heel portion having a second wedge protruding generally upward from the second heel portion;

wherein the article of footwear is transitionable between a first configuration, in which the first heel portion is removably secured to the heel receiver portion of the sole and the first wedge abuttingly holds the block of the support shank in a rearward position relative to the aperture, and a second configuration, in which the second heel portion is removably secured to the heel receiver portion of the sole and the second wedge abuttingly holds the block of the support shank in a forward position relative to the aperture.

A1. The article of footwear of A0, wherein the first heel portion is taller than the second heel portion, such that the article of footwear comprises a higher-heeled shoe when in the first configuration as compared to the second configuration.

A2. The article of footwear of A0, wherein the first heel portion is shorter than the second heel portion, such that the article of footwear comprises a lower-heeled shoe when in the first configuration as compared to the second configuration.

A3. The article of footwear of any of paragraphs A0 through A2, wherein a rear end portion of the support shank is disposed farther rearward with respect to the sole when in the first configuration as compared with the second configuration.

A4. The article of footwear of A3, wherein the entire support shank is movable in a longitudinal direction relative to the sole.

A5. The article of footwear of A3, wherein a front end portion of the support shank is secured to the sole, such that a longitudinal position of the front end portion of the support shank is fixed relative to the sole.

A6. The article of footwear of any of paragraphs A0 through A4, wherein an entirety of the support shank moves with the block, relative to the sole.

A7. The article of footwear of any of paragraphs A0 through A6, wherein the block is cuboidal.

A8. The article of footwear of any of paragraphs A0 through A7, wherein the sole comprises an insole portion and an outsole portion.

A9. The article of footwear of any of paragraphs A0 through A8, wherein the support shank is disposed in a cavity formed in the sole.

A10. The article of footwear of A9, wherein the support shank is slidingly movable in a longitudinal direction within the cavity.

A11. The article of footwear of A9, wherein the cavity is formed entirely in an insole portion of the sole.

A12. The article of footwear of any of paragraphs A0 through A11, wherein the heel receiver of the sole comprises a fixed hook portion, a movable hook portion disposed opposite the fixed hook portion, and an actuator configured to move the movable hook portion between a retracted position and an extended position.

A13. The article of footwear of A12, wherein the movable hook portion is biased toward the extended position.

A14. The article of footwear of A12, each of the first and second heel portions further comprising a first recess configured to engage the fixed hook portion and a second recess configured to engage the movable hook portion, such that, when the heel portion is engaged with the heel receiver, the heel portion is secured to the heel receiver when the movable hook portion is in the extended position and the heel portion is releasable from the heel receiver when the movable hook portion is in the retracted position.

A15. The article of footwear of A12, wherein the aperture extends through the sole between the fixed hook portion and the movable hook portion.

A16. The article of footwear of A12, wherein the fixed hook portion faces rearward and the movable hook portion faces forward.

A17. The article of footwear of any of paragraphs A0 through A16, wherein the support shank comprises a metal plate.

B0. An article of footwear comprising:

a sole including a heel receiver;

a support shank housed within the sole, wherein the support shank is at least partially movable relative to the sole;

a block affixed to a rear portion of the support shank and passing generally downward through an aperture in the sole proximate the heel receiver, a dimension of the aperture in a heel-to-toe direction being larger than the block; and a first heel portion having a first wedge protruding generally upward from the first heel portion;

wherein the article of footwear is in a first configuration, in which the first heel portion is removably secured to the heel receiver portion of the sole and the first wedge abuttingly holds the block of the support shank in a first longitudinal position against a first side of the aperture.

B1. The article of footwear of B0, further comprising:

a second heel portion having a second wedge protruding generally upward from the second heel portion;

wherein the article of footwear is transitionable to a second configuration, in which the first heel portion is removed and the second heel portion is secured to the heel receiver portion of the sole, such that the second wedge abuttingly holds the block of the support shank in a second longitudinal position against a second side of the aperture.

B2. The article of footwear of B1, wherein the first heel portion is taller than the second heel portion, such that the article of footwear comprises a higher-heeled shoe when in the first configuration as compared to the second configuration.

B3. The article of footwear of any of paragraphs B0 through B2, wherein the first longitudinal position is a rearward position.

B4. The article of footwear of any of paragraphs B0 through B3, wherein the entire support shank is movable in a longitudinal direction relative to the sole.

B5. The article of footwear of any of paragraphs B0 through B4, wherein a front end portion of the support shank is secured to the sole, such that the front end portion of the support shank is fixed relative to the sole.

B6. The article of footwear of any of paragraphs B0 through B4, wherein an entirety of the support shank moves with the block, relative to the sole.

B7. The article of footwear of any of paragraphs B0 through B6, wherein the block is cuboidal.

B8. The article of footwear of any of paragraphs B0 through B7, wherein the sole comprises an insole portion and an outsole portion.

B9. The article of footwear of any of paragraphs B0 through B8, wherein the support shank is disposed in a cavity formed in the sole.

B10. The article of footwear of B9, wherein the support shank is slidingly movable within the cavity.

B11. The article of footwear of B9, wherein the cavity is formed entirely in an insole portion of the sole.

B12. The article of footwear of any of paragraphs B0 through B11, wherein the heel receiver of the sole comprises a fixed hook portion, a movable hook portion disposed opposite the fixed hook portion, and an actuator configured to move the movable hook portion between a retracted position and an extended position.

B13. The article of footwear of B12, wherein the movable hook portion is biased toward the extended position.

B14. The article of footwear of B12, the first heel portion further comprising a first recess configured to engage the fixed hook portion and a second recess configured to engage the movable hook portion, such that, when the first heel portion is engaged with the heel receiver, the first heel portion is secured to the heel receiver when the movable hook portion is in the extended position and the first heel portion is releasable from the heel receiver when the movable hook portion is in the retracted position.

B15. The article of footwear of B12, wherein the aperture extends through the sole between the fixed hook portion and the movable hook portion.

B16. The article of footwear of B12, wherein the fixed hook portion faces rearward and the movable hook portion faces forward.

B17. The article of footwear of any of paragraphs B0 through B16, wherein the support shank comprises a metal plate.

Advantages, Features, and Benefits

The different embodiments and examples of the convertible footwear described herein provide several advantages over known solutions. For example, illustrative embodiments and examples described herein allow simple and secure interchange of different-height heels.

Additionally, and among other benefits, illustrative embodiments and examples described herein automatically reposition and/or secure a position of a support shank relative to the sole of the footwear as a result of replacing one heel with another.

Additionally, and among other benefits, illustrative embodiments and examples described herein allow conversion between a high heel and a low heel without the need for tools.

No known system or device can perform these functions]. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. An article of footwear comprising:

a sole including a heel receiver;

a support shank housed within the sole, wherein the support shank is at least partially movable relative to the sole;

a block affixed to a rear portion of the support shank and passing generally downward through an aperture in the sole proximate the heel receiver, a dimension of the aperture in a heel-to-toe direction being larger than the block; and a first heel portion having a first wedge protruding generally upward from the first heel portion;

wherein the article of footwear is in a first configuration, in which the first heel portion is removably secured to the heel receiver of the sole and the first wedge abuttingly holds the block of the support shank in a first longitudinal position against a first side of the aperture.

2. The article of footwear of claim 1, further comprising:

a second heel portion having a second wedge protruding generally upward from the second heel portion;

wherein the article of footwear is transitionable to a second configuration, in which the first heel portion is removed and the second heel portion is secured to the heel receiver of the sole, such that the second wedge abuttingly holds the block of the support shank in a second longitudinal position against a second side of the aperture.

3. The article of footwear of claim 2, wherein the first heel portion is taller than the second heel portion, such that the article of footwear comprises a higher-heeled shoe when in the first configuration as compared to the second configuration.

4. The article of footwear of claim 1, wherein the first longitudinal position is a rearward position.

5. The article of footwear of claim 1, wherein an entirety of the support shank is movable in a longitudinal direction relative to the sole.

6. The article of footwear of claim 1, wherein a front end portion of the support shank is secured to the sole, such that the front end portion of the support shank is fixed relative to the sole.

7. The article of footwear of claim 1, wherein the support shank is disposed in a cavity formed in the sole.

8. The article of footwear of claim 1, wherein the heel receiver of the sole comprises a fixed hook portion, a movable hook portion disposed opposite the fixed hook portion, and an actuator configured to move the movable hook portion between a retracted position and an extended position.

9. The article of footwear of claim 8, the first heel portion further comprising a first recess configured to engage the fixed hook portion and a second recess configured to engage the movable hook portion, such that, when the first heel portion is engaged with the heel receiver, the first heel portion is secured to the heel receiver when the movable hook portion is in the extended position and the first heel portion is releasable from the heel receiver when the movable hook portion is in the retracted position.

10. The article of footwear of claim 9, wherein the aperture extends through the sole between the fixed hook portion and the movable hook portion.

11. An article of footwear comprising:

a sole including a heel receiver;

a support shank housed within the sole, wherein the support shank and the sole are at least partially movable relative to each other;

a block affixed to a rear portion of the support shank and passing generally downward through an aperture in the sole proximate the heel receiver, a longitudinal dimension of the aperture being larger than the block;

a first heel portion having a first wedge protruding generally upward from the first heel portion; and a second heel portion having a second wedge protruding generally upward from the second heel portion;

wherein the article of footwear is transitionable between a first configuration, in which the first heel portion is removably secured to the heel receiver of the sole and the first wedge abuttingly holds the block of the support shank in a rearward position relative to the aperture, and a second configuration, in which the second heel portion is removably secured to the heel receiver of the sole and the second wedge abuttingly holds the block of the support shank in a forward position relative to the aperture.

12. The article of footwear of claim 11, wherein the first heel portion is taller than the second heel portion, such that the article of footwear comprises a higher-heeled shoe when in the first configuration as compared to the second configuration.

13. The article of footwear of claim 11, wherein the first heel portion is shorter than the second heel portion, such that the article of footwear comprises a lower-heeled shoe when in the first configuration as compared to the second configuration.

14. The article of footwear of claim 11, wherein a rear end portion of the support shank is disposed farther rearward with respect to the sole when in the first configuration as compared with the second configuration.

15. The article of footwear of claim 14, wherein an entirety of the support shank is movable in a longitudinal direction relative to the sole.

16. The article of footwear of claim 14, wherein a front end portion of the support shank is secured to the sole, such that a longitudinal position of the front end portion of the support shank is fixed relative to the sole.

17. The article of footwear of claim 11, wherein the support shank is disposed in a cavity formed in the sole.

18. The article of footwear of claim 17, wherein the support shank is slidingly movable in a longitudinal direction within the cavity.

19. The article of footwear of claim 11, wherein the heel receiver of the sole comprises a fixed hook portion, a movable hook portion disposed opposite the fixed hook portion, and an actuator configured to move the movable hook portion between a retracted position and an extended position.

20. The article of footwear of claim 19, each of the first and second heel portions further comprising a first recess configured to engage the fixed hook portion and a second recess configured to engage the movable hook portion, such that, when the respective heel portion is engaged with the heel receiver, the respective heel portion is secured to the heel receiver when the movable hook portion is in the extended position and the respective heel portion is releasable from the heel receiver when the movable hook portion is in the retracted position.

* * * * *